US007430377B2

(12) United States Patent
Koike et al.

(10) Patent No.: US 7,430,377 B2
(45) Date of Patent: Sep. 30, 2008

(54) IMAGE FORMING APPARATUS AND PROCESS CARTRIDGE HAVING A DETACHABLE UNIT BODY HAVING A LUBRICANT APPLYING UNIT AND IMAGE CARRIER MOUNTED THEREON

(75) Inventors: Toshio Koike, Kanagawa (JP); Ken Amemiya, Tokyo (JP); Naohiro Kumagai, Kanagawa (JP); Masato Yanagida, Tokyo (JP); Masanori Kawasumi, Kanagawa (JP); Takeshi Uchitani, Kanagawa (JP); Yutaka Takahashi, Tokyo (JP); Yuji Arai, Kanagawa (JP); Takaaki Tawada, Kanagawa (JP); Masami Tomita, Shizuoka (JP); Takeshi Tabuchi, Saitama (JP); Eisaku Murakami, Tokyo (JP); Takeshi Shintani, Kanagawa (JP); Takuji Yoneda, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 174 days.

(21) Appl. No.: 10/921,923

(22) Filed: Aug. 20, 2004

(65) Prior Publication Data

US 2005/0084271 A1 Apr. 21, 2005

(30) Foreign Application Priority Data

Aug. 22, 2003 (JP) ..... 2003-298507

(51) Int. Cl.
*G03G 15/00* (2006.01)

(52) U.S. Cl. ..... 399/12

(58) Field of Classification Search ..... 399/12, 399/346

See application file for complete search history.

(56) References Cited

U.S. PATENT DOCUMENTS 4,757,349 A * 7/1988 Toshimitsu et al. ..... 399/346
5,486,909 A 1/1996 Takenaka et al.

(Continued)

FOREIGN PATENT DOCUMENTS

EP 1403742 A2 * 3/2004

(Continued)

OTHER PUBLICATIONS

U.S. Appl. No. 10/921,923, filed Aug. 20, 2004, Koike, et al.

(Continued)

*Primary Examiner*—Quana M Grainger
(74) *Attorney, Agent, or Firm*—Oblon, Spivak, McClelland, Maier & Neustadt, P.C.

(57) ABSTRACT

An image forming apparatus includes an image carrier, a charging unit that charges the image carrier, a latent image forming unit that forms a latent image on the image carrier, a developing unit that develops the latent image to form a toner image, a transferring unit that transfers the toner image to a recording medium, a cleaning unit that cleans toner remaining on the image carrier, a lubricant applying unit that applies a solid lubricant to a surface of the image carrier, and a detecting unit that detects whether the image carrier is brand new. The toner has an average roundness of 0.94 or more. The lubricant applying unit is operated when the detecting unit detects that the image carrier is brand new.

26 Claims, 6 Drawing Sheets

U.S. PATENT DOCUMENTS

| | | | | |
|---|---|---|---|---|
| 5,489,747 | A | | 2/1996 | Takenaka et al. |
| 5,596,395 | A | | 1/1997 | Sawamura et al. |
| 5,610,691 | A | | 3/1997 | Takahashi et al. |
| 5,617,191 | A | | 4/1997 | Murakami et al. |
| 5,625,439 | A | | 4/1997 | Murakami |
| 5,625,440 | A | | 4/1997 | Matsumae et al. |
| 5,649,265 | A | | 7/1997 | Tabuchi |
| 5,666,625 | A | | 9/1997 | Komatsubara et al. |
| 5,689,782 | A | | 11/1997 | Murakami et al. |
| 5,697,026 | A | | 12/1997 | Matsumae et al. |
| 5,721,083 | A | | 2/1998 | Masuda et al. |
| 5,734,952 | A | | 3/1998 | Murakami et al. |
| 5,761,594 | A | | 6/1998 | Seto et al. |
| 5,768,665 | A | | 6/1998 | Yamanaka et al. |
| 5,792,533 | A | | 8/1998 | Kurokawa et al. |
| 5,826,144 | A | | 10/1998 | Takenaka et al. |
| 5,840,456 | A | | 11/1998 | Tomita et al. |
| 5,851,716 | A | | 12/1998 | Kuramoto et al. |
| 5,879,752 | A | | 3/1999 | Murakami et al. |
| 5,881,339 | A | | 3/1999 | Yanagida et al. |
| 5,887,224 | A | | 3/1999 | Mizuishi et al. |
| 5,897,243 | A | | 4/1999 | Komatsubara et al. |
| 5,915,143 | A | | 6/1999 | Watanabe et al. |
| 5,970,282 | A | | 10/1999 | Tanagida et al. |
| 5,975,446 | A | | 11/1999 | Yaguchi et al. |
| 5,995,789 | A | | 11/1999 | Murakami et al. |
| 6,006,050 | A | | 12/1999 | Watanabe et al. |
| 6,023,342 | A | | 2/2000 | Yanagida |
| 6,032,006 | A | | 2/2000 | Yanagida |
| 6,055,388 | A | | 4/2000 | Watanabe et al. |
| 6,072,977 | A | | 6/2000 | Murakami |
| 6,074,794 | A | | 6/2000 | Fushimi et al. |
| 6,085,062 | A | | 7/2000 | Mizuishi et al. |
| 6,103,441 | A | | 8/2000 | Tomita et al. |
| 6,128,449 | A | | 10/2000 | Zenba et al. |
| 6,144,811 | A | | 11/2000 | Ohori et al. |
| 6,144,822 | A | | 11/2000 | Yamaguchi et al. |
| 6,148,161 | A | | 11/2000 | Usui et al. |
| 6,160,969 | A | | 12/2000 | Ishigaki et al. |
| 6,160,977 | A | * | 12/2000 | Takeichi et al. ..... 399/127 |
| 6,226,481 | B1 | | 5/2001 | Yoneda et al. |
| 6,253,044 | B1 | * | 6/2001 | Shoji et al. ..... 399/111 |
| 6,266,501 | B1 | | 7/2001 | Mizuishi et al. |
| 6,269,228 | B1 | | 7/2001 | Kayahara et al. |
| 6,363,229 | B1 | | 3/2002 | Shiraishi et al. |
| 6,405,006 | B1 | | 6/2002 | Tabuchi |
| 6,438,329 | B1 | * | 8/2002 | Budnik et al. ..... 399/24 |
| 6,505,024 | B2 | | 1/2003 | Kayahara et al. |
| 6,539,189 | B2 | | 3/2003 | Yanagida |
| 6,597,881 | B2 | | 7/2003 | Hatori et al. |
| 6,615,013 | B2 | | 9/2003 | Arai et al. |
| 6,628,903 | B1 | | 9/2003 | Ohori et al. |
| 6,628,912 | B2 | | 9/2003 | Amemiya et al. |
| 6,640,076 | B2 | | 10/2003 | Shintani |
| 6,654,574 | B2 | | 11/2003 | Kayahara et al. |
| 6,660,443 | B2 | | 12/2003 | Sugiyama et al. |
| 6,665,512 | B1 | | 12/2003 | Yanagida et al. |
| 6,682,866 | B2 | | 1/2004 | Sugiyama et al. |
| 6,701,118 | B2 | | 3/2004 | Kayahara et al. |
| 6,740,460 | B2 | | 5/2004 | Tomita et al. |
| 6,756,175 | B2 | | 6/2004 | Emoto et al. |
| 6,757,505 | B2 | | 6/2004 | Amemiya et al. |
| 6,785,486 | B2 | * | 8/2004 | Yoshida et al. ..... 399/71 |
| 2005/0084271 | A1 | | 4/2005 | Koike et al. |

FOREIGN PATENT DOCUMENTS

| | | | | |
|---|---|---|---|---|
| JP | 62262885 | A | * | 11/1987 |
| JP | 1-112253 | | | 4/1989 |
| JP | 2-284158 | | | 11/1990 |
| JP | 3-181952 | | | 8/1991 |
| JP | 4-162048 | | | 6/1992 |
| JP | 5-72808 | | | 3/1993 |
| JP | 08320641 | A | * | 12/1996 |
| JP | 9-15902 | | | 1/1997 |
| JP | 09022234 | A | * | 1/1997 |
| JP | 09160468 | A | * | 6/1997 |
| JP | 10247050 | A | * | 9/1998 |
| JP | 11-133668 | | | 5/1999 |
| JP | 11-184340 | | | 7/1999 |
| JP | 2002-287567 | | | 10/2002 |

OTHER PUBLICATIONS

U.S. Appl. No. 11/060,421, filed Feb. 18, 2005, Koike, et al.
U.S. Appl. No. 11,090,565, filed Mar. 28, 2005, Toshio, et al.
U.S. Appl. No. 11/100,813, filed Apr. 7, 2005, Ojimi et al.
U.S. Appl. No. 11/206,812, filed Aug. 19, 2005, Tawada.
U.S. Appl. No. 11/207,819, filed Aug. 22, 2005, Shintani et al.
U.S. Appl. No. 11/512,385, filed Aug. 30, 2006, Tomita.
U.S. Appl. No. 11/734,895, filed Apr. 13, 2007, Yamashita, et al.
U.S. Appl. No. 11/685,660, filed Mar. 13, 2007, Shintani et al.
U.S. Appl. No. 10/053,542, filed Jan. 24, 2002, Amemiya et al.
U.S. Appl. No. 10/092,488, filed Mar. 8, 2002, Arai et al.
U.S. Appl. No. 10/092,920, filed Mar. 8, 2002, Yamashita.
U.S. Appl. No. 10/112,769, filed Apr. 2, 2002, Yamashita et al.
U.S. Appl. No. 10/158,069, filed May 31, 2002, Matsuda et al.
U.S. Appl. No. 10/188,049, filed Jul. 3, 2002, Yamashita et al.
U.S. Appl. No. 10/246,601, filed Sep. 19, 2002, Emoto et al.
U.S. Appl. No. 10/247,639, filed Sep. 20, 2002, Yamashita et al.
U.S. Appl. No. 10/252,070, filed Sep. 23, 2002, Aoki et al.
U.S. Appl. No. 10/286,816, filed Nov. 4, 2002, Emoto et al.
U.S. Appl. No. 10/284,177, filed Oct. 31, 2002, Yagi et al.
U.S. Appl. No. 10/285,636, filed Nov. 1, 2002, Higuchi et al.
U.S. Appl. No. 10/286,791, filed Nov. 4, 2002, Yamashita et al.
U.S. Appl. No. 10/303,910, filed Nov. 26, 2002, Sampe et al.
U.S. Appl. No. 10/352,062, filed Jan. 28, 2003, Yanagida.
U.S. Appl. No. 10/394,265, filed Mar. 24, 2003, Nanya et al.
U.S. Appl. No. 10/401,554, Mar. 31, 2003, Kimura et al.
U.S. Appl. No. 10/405,630, filed Apr. 3, 2003, Suda et al.
U.S. Appl. No. 10/418,111, filed Apr. 18, 2003, Kawahara et al.
U.S. Appl. No. 10/464,537, filed Jun. 19, 2003, Kayahara et al.
U.S. Appl. No. 10/610,883, filed Jul. 2, 2003, Ohori et al.
U.S. Appl. No. 10/607,014, filed Jun. 27, 2003, Tomita et al.
U.S. Appl. No. 10/250,667, filed Jul. 7, 2003, Emoto et al.
U.S. Appl. No. 10/630,848, filed Jul. 31, 2003, Iwasaki et al.
U.S. Appl. No. 10/631,727, filed Aug. 1, 2003, Suzuki et al.
U.S. Appl. No. 10/636,637, filed Aug. 8, 2003, Hosokawa et al.
U.S. Appl. No. 10/645,804, filed Aug. 22, 2003, Tomita et al.
U.S. Appl. No. 10/650,754, filed Aug. 29, 2003, Koichi et al.
U.S. Appl. No. 10/660,636, filed Sep. 12, 2003, Ishii et al.
U.S. Appl. No. 10/652,505, filed Sep. 2, 2003, Murakami et al.
U.S. Appl. No. 10/660,620, filed Sep. 12, 2003, Murakami et al.
U.S. Appl. No. 10/668,498, filed Sep. 24, 2003, Yanagida et al.
U.S. Appl. No. 10/661,569, filed Sep. 15, 2003, Kosuge et al.
U.S. Appl. No. 10/665,494, filed Sep. 22, 2003, Kawasumi et al.
U.S. Appl. No. 10/670,320, filed Sep. 26, 2003, Watanabe et al.
U.S. Appl. No. 10/665,825, filed Sep. 22, 2003, Yoshizawa et al.
U.S. Appl. No. 10/666,254, filed Sep. 22, 2003, Kondo et al.
U.S. Appl. No. 10/668,311, filed Sep. 24, 2003, Murakami et al.
U.S. Appl. No. 10/680,246, filed Oct. 8, 2003, Sugiyama et al.
U.S. Appl. No. 10/681,185, filed Oct. 9, 2003, Sugiyama et al.
U.S. Appl. No. 10/689,670, filed Oct. 22, 2003, Yanagida et al.
U.S. Appl. No. 10/724,260, filed Dec. 1, 2003, Emoto et al.
U.S. Appl. No. 10/724,150, filed Dec. 1, 2003, Tomita et al.
U.S. Appl. No. 10/707,000, filed Nov. 14, 2003, Tomita et al.
U.S. Appl. No. 10/703,447, filed Nov. 10, 2003, Yoshiyuki et al.
U.S. Appl. No. 10/712,026, filed Nov. 14, 2003, Tomita et al.
U.S. Appl. No. 10/725,402, filed Dec 3, 2003, Shintani et al.
U.S. Appl. No. 10/746,060, filed Dec. 29, 2003, Enoki et al.
U.S. Appl. No. 10/729,960, filed Dec. 9, 2003, Tomita et al.
U.S. Appl. No. 10/740,665, filed Dec. 22, 2003, Nagashima et al.
U.S. Appl. No. 10/733,247, filed Dec. 12, 2003, Nanya et al.
U.S. Appl. No. 10/742,835, filed Dec. 23, 2003, Tsuda et al.

U.S. Appl. No. 10/760,452, filed Jan. 21, 2004, Higuchi et al.
U.S. Appl. No. 10/792,694, filed Mar. 5, 2004, Tsuda et al.
U.S. Appl. No. 10/683,844, filed Oct. 10, 2003, Unknown.
U.S. Appl. No. 10/032,172, filed Dec. 21, 2001, Unknown.
U.S. Appl. No. 09/864,596, filed May 24, 2001, Unknown.
U.S. Appl. No. 09/384,797, filed Aug. 27, 1999, Unknown.
U.S. Appl. No. 08/451,987, filed May 26, 1995, Yanagida.
U.S. Appl. No. 09/033,643, filed Mar. 3, 1998, Aoto et al.

* cited by examiner

IMAGE FORMING APPARATUS AND PROCESS CARTRIDGE HAVING A DETACHABLE UNIT BODY HAVING A LUBRICANT APPLYING UNIT AND IMAGE CARRIER MOUNTED THEREON

CROSS-REFERENCE TO RELATED APPLICATIONS

The present document incorporates by reference the entire contents of Japanese priority document, 2003-298507 filed in Japan on Aug. 22, 2003.

BACKGROUND OF THE INVENTION

1) Field of the Invention

The present invention relates to an image forming apparatus for electrophotographic processing, such as a copy machine, a facsimile, and a printer, and more particularly, to an image forming apparatus in which a cleaning of an image carrier is well performed even with use of a toner of a relatively high average roundness.

2) Description of the Related Art

A color image forming apparatus that employs an electrophotographic system is now widely used. Moreover, a high-definition of an image to be printed is desired in association with easy availability of digitalized images. In the study of higher resolution and gradation of images, further conglobation and granulation to finer particle diameter are under research for improvement of a toner that makes latent images visualized in order to form images with the high definition.

For example, several methods are proposed, in which conglobated ground-type toner having a specific particle diameter distribution is obtained (see, for example, Japanese Patent Application Laid-Open Publication No. 1989-112253, Japanese Patent Application Laid-Open Publication No. 1990-284158, Japanese Patent Application Laid-Open Publication No. 1991-181952, and Japanese Patent Application Laid-Open Publication No. 1992-162048), toner conglobated and granulated to smaller particle diameter by suspension polymerization is obtained (see, for example, Japanese Patent Application Laid-Open Publication No. 1993-72808), toner conglobated and granulated to finer particle diameter is obtained by mixing a binding resin and a colorant in a solvent that is not mixable with water, followed by dispersing the mixture in an aqueous solvent in the presence of a dispersion stabilizer (see, for example, Japanese Patent Application Laid-Open Publication No. 1997-15902), and toner conglobated and granulated to smaller particle diameter is obtained by mixing a binding resin containing a partially denatured resin and a colorant in an organic solvent and dispersing the mixture in an aqueous solvent, followed by polyaddition reaction of the denatured resin (see, for example, Japanese Patent Application Laid-Open Publication No. 1999-133668). With the use of the above type of toner, image quality and fluidity are improved.

The toner granulated to finer particle diameter and conglobated is suitable for obtaining images with the high definition because the toner is accurately transferred; however, the conglobated toner is easy to roll down. Therefore, the toner rolls between a cleaning blade and a photosensitive member in a cleaning unit, which makes cleaning difficult. This may result in causes of abnormal images such as background fog.

To cope with the problem, a scheme has been suggested in which a lubricant, such as zinc stearate, is supplied to the surface of a photosensitive member so as to adjust a coefficient of friction on the surface of the photosensitive member, thereby improving cleaning ability. Suggested as an exemplary scheme of supplying a lubricant on the photosensitive member is a method of forming an electrophotographic image using a cleaning member for cleaning, with an elastic rubber blade, a toner remaining on a photosensitive member after transferred to a recording member, wherein the toner contains zinc stearate of equal to or more than 0.01% and equal to or less than 0.5% with respect to the weight of the toner, and the elastic rubber blade is substantially held by a supporting member to be fixed to the cleaning member on a side of a surface on which an image carrier of the cleaning blade is abutted (see, for example, Japanese Patent Application Laid-Open Publication No. 11-184340). However, if zinc stearate is added to the toner, zinc stearate on the image carrier might be non-uniform depending on the state of the image being developed.

Also, another image forming apparatus has been suggested for forming an electrostatic latent image on an image carrier, visualizing the electrostatic latent image as a toner image by using a toner containing a release agent, transferring the toner image on a recording medium directly or via an intermediate transfer member, and fixing the toner image transferred on the recording medium, wherein a lubricant is applied to the image carrier (see, for example, Japanese Patent Application Laid-Open Publication No. 2003-140518).

In the apparatus suggested above, a lubricant applying unit brings a brush-shaped roller into contact with a solid lubricant formed in a block shape, scrapes the solid lubricant by the rotation of the brush-shaped roller, and then, in the downstream of the rotating direction, brings the brush-shaped roller into contact with the surface of the image carrier for applying the lubricant on the surface of the image carrier. However, the solid lubricant has been processed so as not to be prone to lose its shape, and therefore has a hardened surface. Unless this hardened layer is scraped, uniform application onto the surface of the image carrier cannot be achieved. Therefore, when the solid lubricant is first used, an effect of reducing the coefficient of friction on the surface of the image carrier cannot be obtained until the hardened layer is scraped. Thus, it is also difficult to achieve a satisfactory ability of cleaning the image carrier from the beginning.

SUMMARY OF THE INVENTION

It is an object of the present invention to solve at least the above problems in the conventional technology.

An image forming apparatus according to one aspect of the present invention includes an image carrier that carries a latent image; a charging unit that charges the image carrier by bringing a charging member to come in contact with or to come close to a surface of the image carrier; a latent image forming unit that forms the latent image on the image carrier; a developing unit that develops the latent image by bringing toner to adhere to the latent image to form a toner image on the image carrier; a transferring unit that transfers the toner image to a recording medium moving tightly held between a surface of the image carrier and a surface moving member or to the surface moving member by forming a transfer electric field between the image carrier and the surface moving member that moves in contact with the surface of the image carrier; a cleaning unit that cleans toner remaining on the image carrier with a cleaning blade; a lubricant applying unit that includes a solid lubricant and a brush-shaped roller, and applies the solid lubricant to the surface of the image carrier by scraping the solid lubricant with the brush-shaped roller; and a detecting unit that detects whether the image carrier is brand new. The toner has an average roundness of 0.94 or more. The lubricant applying unit is operated when the detecting unit detects that the image carrier is brand new.

A process cartridge according to another aspect of the present invention is detachably arranged in an image forming apparatus. The image forming apparatus includes an image carrier that carries a latent image; a charging unit that charges the image carrier by bringing a charging member to come in contact with or to come close to a surface of the image carrier; a latent image forming unit that forms the latent image on the image carrier; a developing unit that develops the latent image by bringing toner to adhere to the latent image to form a toner image on the image carrier; a transferring unit that transfers the toner image to a recording medium moving tightly held between a surface of the image carrier and a surface moving member or to the surface moving member by forming a transfer electric field between the image carrier and the surface moving member that moves in contact with the surface of the image carrier; a cleaning unit that cleans toner remaining on the image carrier with a cleaning blade; a lubricant applying unit that includes a solid lubricant and a brush-shaped roller, and applies the solid lubricant to the surface of the image carrier by scraping the solid lubricant with the brush-shaped roller; and a detecting unit that detects whether the image carrier is brand new. The image carrier and at least one of the charging unit, the developing unit, and the cleaning unit are integrally supported in the process cartridge. The lubricant applying unit is operated when the detecting unit detects that the image carrier is brand new.

A toner according to still another aspect of the present invention is used in a developing step of an electrophotographic process. The toner is used in an image forming apparatus that includes an image carrier that carries a latent image; a charging unit that charges the image carrier by bringing a charging member to come in contact with or to come close to a surface of the image carrier; a latent image forming unit that forms the latent image on the image carrier; a developing unit that develops the latent image by bringing toner to adhere to the latent image to form a toner image on the image carrier; a transferring unit that transfers the toner image to a recording medium moving tightly held between a surface of the image carrier and a surface moving member or to the surface moving member by forming a transfer electric field between the image carrier and the surface moving member that moves in contact with the surface of the image carrier; a cleaning unit that cleans toner remaining on the image carrier with a cleaning blade; a lubricant applying unit that includes a solid lubricant and a brush-shaped roller, and applies the solid lubricant to the surface of the image carrier by scraping the solid lubricant with the brush-shaped roller; and a detecting unit that detects whether the image carrier is brand new. The lubricant applying unit is operated when the detecting unit detects that the image carrier is brand new. The toner has an average particle diameter per volume in a range of 3 micrometers to 8 micrometers and a ratio of the average particle diameter per volume to an average particle diameter per number in a range of 1.00 to 1.40.

The other objects, features, and advantages of the present invention are specifically set forth in or will become apparent from the following detailed description of the invention when read in conjunction with the accompanying drawings.

DETAILED DESCRIPTION

Exemplary embodiments of an image forming apparatus, a process cartridge, and a toner according to the present invention are described in detail with reference to the accompanying drawings.

Figure 1:
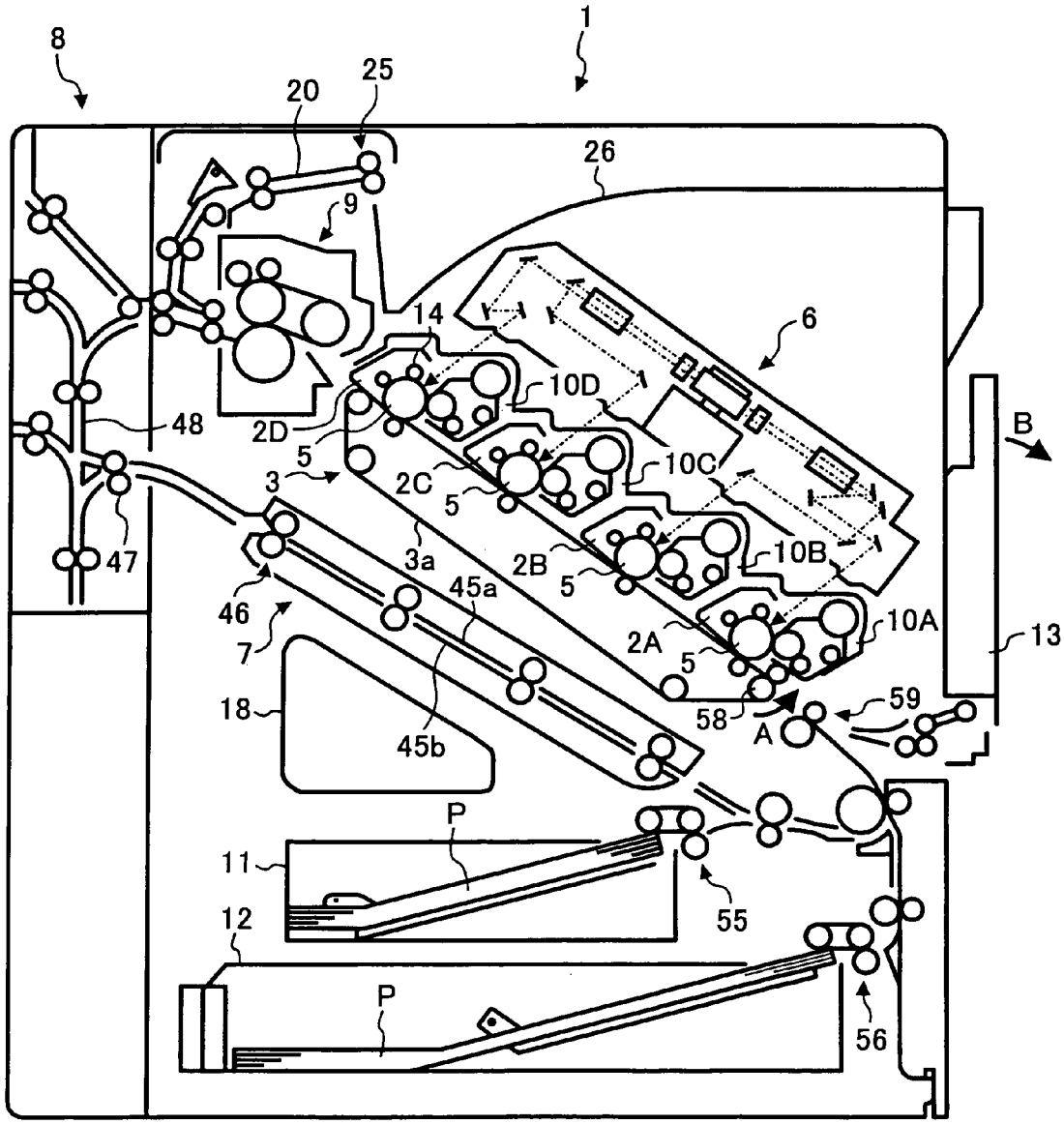
FIG. 1 is schematic of a small-scale full-color printer to which the present invention is applied.

FIG. 1 is schematic of a small-scale full-color printer to which the present invention is applied. In a main body of image forming apparatus 1 (hereinafter, "main body"), image forming units 2A, 2B, 2C, and 2D including four photosensitive members that are image carriers are detachably attached, respectively, to the main body 1. A transfer unit 3 in which a transfer belt 31 is attached rotatably in the direction shown by an arrow A among a plurality of rollers is arranged in the approximate center of the main body 1.

Each of the photosensitive members 5 provided to each of the image forming units 2A, 2B, 2C, and 2D is arranged so that the photosensitive members 5 are in contact with the upper surface of the transfer belt 31. Developing units 10A, 10B, 10C, and 10D each of which uses each different toner color are arranged correspondingly to the image forming units 2A, 2B, 2C, and 2D.

The structure of the image forming units 2A, 2B, 2C, and 2D is identical to one another. The image forming unit 2A forms images corresponding to magenta color, the image forming unit 2B forms images corresponding to cyan color, the image forming unit 2C forms images corresponding to yellow color, and the image forming unit 2D forms images corresponding to black color.

A writing unit 6 is arranged above the image forming units 2A, 2B, 2C, and 2D, and a duplex unit 7 is arranged below the transfer belt 31. This small printer is provided with a reversing unit 8 at the left hand of the main body 1, in which transfer paper is reversed to be delivered after image formation or is conveyed to the duplex unit 7.

The writing unit 6 is composed of four light sources of laser diode (LD) prepared for each different color, a set of polygon scanners including a hexagonal polygon mirror and a polygon motor, lenses such as fθ lens and long cylindrical lens, and a mirror arranged in each path of the light sources. Laser beams emitted from the laser diodes are polarized by the polygon scanners to be radiated on the photosensitive members 5.

The developing devices 10A, 10B, 10C, and 10D are identical in structure, but use different toner colors in a two-component-development scheme 10A, 10B, 10C, and 10D. The developing device 10A uses a magenta toner, the developing device 10B uses a cyan color, the developing device 10C uses a yellow toner, the developing device 10D uses a black toner. Also, each color of the developing devices 10A, 10B, 10C, and 10D includes a developer composed of the toner and a magnetic carrier. To output images with high quality and high definition, the developing devices 10 of the present image forming apparatus use high-roundness toners whose average roundness is equal to or higher than 0.94.

Each of the developing units 10A, 10B, 10C, and 10D is composed of a developing roller opposite to the photosensitive member 5, a screw that delivers and agitates a developer, a toner concentration sensor, and the like. The developing roller is composed of a rotatable sleeve arranged outside and a magnet fixed inside. Toner is supplied from a toner supplying device according to outputs from the toner concentration sensor. In the present embodiment, a two-component developer composed of toner and a carrier is used as a developer.

The carrier composed of a core material itself or one that is provided with an applying layer over the core material is generally used. The core material for the carrier of a resin applying layer that can be used for the present invention includes ferrite and magnetite. An appropriate particle diameter of this core substance is 20 micrometers to 65 micrometers, and preferably about 30 micrometers to 60 micrometers. Styrene resin, acrylic resin, fluororesin, silicone resin, or a mixture and a copolymer thereof may be used for the resin used for forming the carrier applying layer. As to a forming method of the applying layer, similarly to conventional methods, the applying layer may be formed by means such as spraying method and immersion method in which the surface of particles of the carrier core material is applied with the resin.

The duplex unit 7 includes conveyer guide plates 45*a* and 45*b*, and a plurality of (in this case, four) paired conveyer rollers 46. In a duplex image forming mode in which an image is formed on both sides of transfer paper P, the duplex unit 7 receives the transfer paper P having formed an image on one side that has been switchback-conveyed to a reverse paper delivery path 54 of the reversing unit 8, and then conveys the transfer paper P to a paper feeding unit.

The reversing unit 8 includes a plurality of paired conveyer rollers 47 and a plurality of paired conveyer guide plates 48. As described above, the reversing unit 8 reverses the side of the transfer paper P for duplex image forming and then conveys the reversed transfer paper P to the duplex unit 7. Also, after image forming, the reversing unit 8 delivers the transfer paper P, with its orientation unchanged or with its side reversed, to the outside of the apparatus.

Between the transfer belt 3*a* and the reversing unit 8, a fixing device 9 is provided for fixing the image transferred on the transfer paper P. On the downstream side of the fixing device 9 in a direction of conveying transfer paper, a reverse paper delivery path 20 is provided in a branched manner so as to allow the conveyed transfer paper P to be delivered by a paired paper delivery roller 25 onto a paper delivery tray 26.

Also, on the lower portion of the apparatus body 1, paper feeding cassettes 11 and 12 that can accommodate transfer paper of different sizes are vertically disposed to form the paper feeding unit. The paper feeding unit with the paper feeding cassettes 11 and 12 being disposed is provided with sheet-separating feeder 55 and 56, respectively, for feeding each separate sheet of transfer paper P. Furthermore, on the right side surface of the apparatus body 1, a manual paper feeding tray 13 is provided so as to be open and close in a direction of an arrow B. With the manual paper feeding tray 13 being open, manual paper feeding can be performed.

Figure 2:
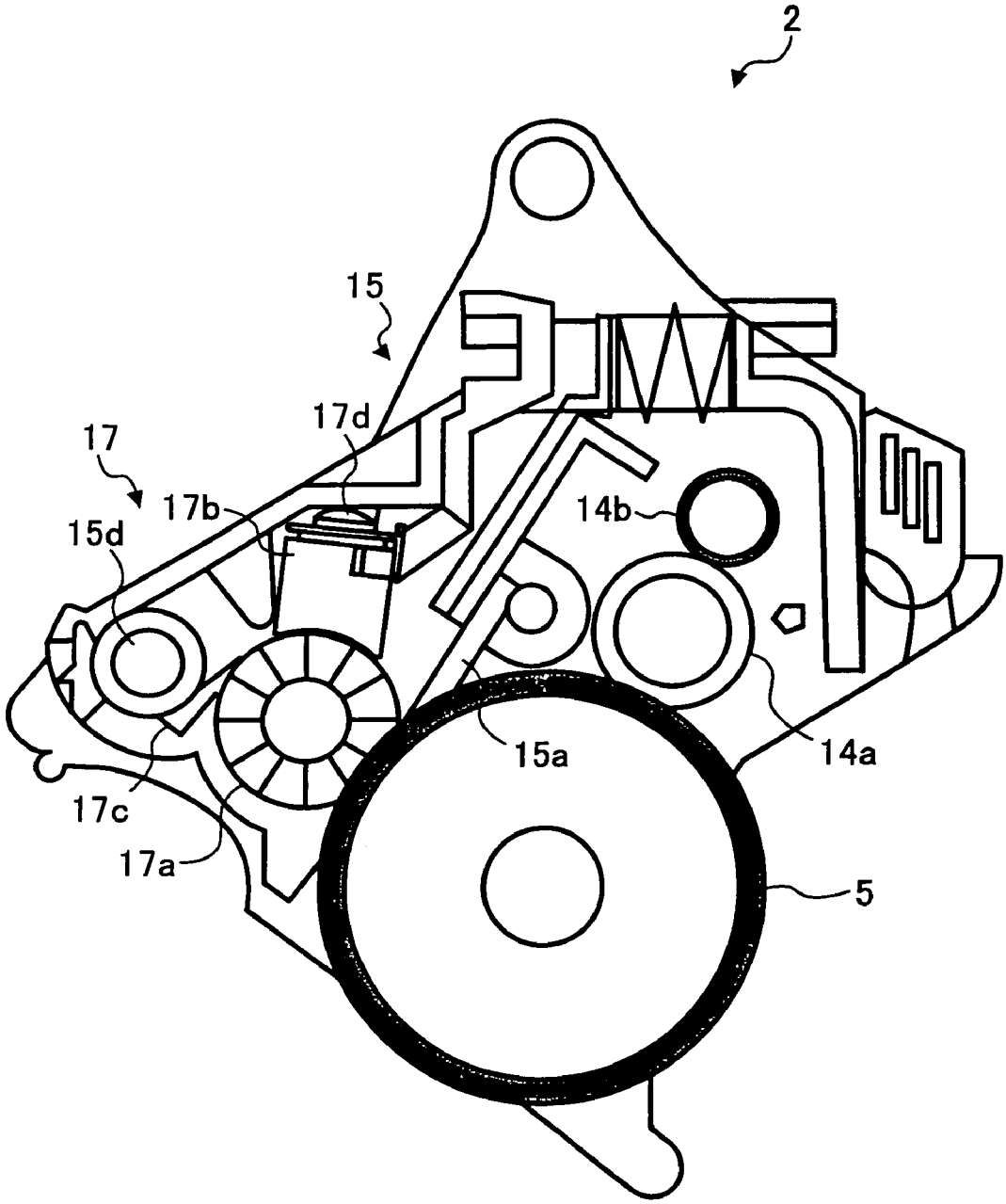
FIG. 2 is a schematic of a photosensitive member unit.

FIG. 2 is a schematic diagram showing the structure of each photosensitive member unit. As shown in FIG. 2, each of the photosensitive member units 2A, 2B, 2C and 2D includes a charging roller 14*a*, a photosensitive member 5 on which an electrostatic latent image is formed, a cleaning unit 15 including a cleaning blade 15*a* for cleaning the surface of the photosensitive member 5, and a lubricant applying unit 17 including a brush-shaped roller 17*a* for applying a lubricant.

The charging roller 14*a* is electrically conductive or semiconductive, and applies either one or both of a direct-current voltage and alternate-current voltage to supply electric charge onto the photosensitive member 5, thereby charging the photosensitive member 5. The charging roller 14*a* is in contact with a charging roller brush 14*b* for cleaning the surface of the roller.

In the cleaning unit 15, the toner is scraped by the cleaning blade 15*a*, and is then moved by the brush-shaped roller 17*a* to a toner conveyer auger 15*d* side. With the toner conveyer auger 15*d* being rotated, the waste toner is collected, and is then conveyed to a waste toner storage unit not shown.

Here, the lubricant applying unit 17 is incorporated in the body of the photosensitive unit 2, and mainly includes a solid lubricant 17*b*, the brush-shaped roller 17*a* in contact with the solid lubricant 17*b* for scraping the lubricant for supply onto the surface of the photosensitive member 5, a brush-shaped roller scraper 17*c* for removing the toner attached to the brush-shaped roller 17*a*, and a pressure spring 17*d* for applying the solid lubricant 17*b* to the brush-shaped roller 17*a* at a predetermined pressure. The solid lubricant 17*b* has been processed to be formed in a block shape. The brush-shaped roller 17*a* is shaped so as to extend in a direction of the axis of the photosensitive member 5. The pressure spring 17*d* is pressed onto the brush-shaped roller 17*a* so that the solid lubricant 17*b* can be almost completely consumed. Since the solid lubricant 17*b* is a consumable, its thickness is decreased with time. However, the solid lubricant 17*b* is always in contact with the brush-shaped roller 17*a* pressured by the pressure spring 17*a* and, after being scraped, is then supplied and applied to the photosensitive member 5.

Next, the image forming operation of this image forming apparatus is described. When the image forming operation is started, each photosensitive member 5 rotates clockwise. Then, the surface of each photosensitive member 5 is uniformly charged by the charging roller 14*a*. Then, from the writing unit 6, a laser light corresponding to a magenta image is emitted to the photosensitive member 5 of the photosensitive member unit 2A, a laser light corresponding to a cyan image is emitted to the photosensitive member 5 of the photosensitive member 2B, a laser light corresponding to a yellow image is emitted to the photosensitive member 5 of the photosensitive member 2C, and a laser light corresponding to a black image is emitted to the photosensitive member 5 of the photosensitive member 2D. With this, a latent image corresponding to each piece of color image data is formed. On reaching the relevant one of the developing devices 10A, 10B, 10C, and 10D with the rotation of the photosensitive member 5, each latent image is developed with the relevant one of toners of magenta, cyan, yellow, and black to form a four-colored image.

Meanwhile, the transfer paper P is supplied by the sheet-separating feeder 55 or 56 from the paper feeding cassette 11 or 12, and is then conveyed by a paired resist roller 59 provided immediately before the transfer belt 3*a* at a timing coinciding with a timing of the toner image formed on each photosensitive member 5. The transfer paper P is charged with a positive polarity by a paper charging roller 58 disposed near the entrance of the transfer belt 3*a*, thereby being electrostatically attached to the surface of the transfer belt 3*a*. Then, while the transfer paper P is conveyed as being attached to the transfer belt 3*a*, magenta, cyan, yellow, and black toner images are sequentially transferred to the transfer paper P, thereby forming a full-color toner image with four colors.

On the transfer paper P with the toner image being transferred thereto, the toner image is fused and fixed by heat and pressure at the fixing device 9. Then, the transfer paper P is delivered through a delivery system according to a specified mode. For example, the transfer paper P is delivered to the paper delivery tray 26 provided on the upper portion of the apparatus body 1 through reverse delivery. Alternatively, the transfer paper P is delivered straight from the fixing device 9 through the reversing unit 8. Still alternatively, when a duplex image forming mode is selected, the transfer paper P is first delivered to the reverse paper delivery path of the reversing unit 8, switched back to the duplex unit 7, supplied again to an image forming unit provided with the photosensitive member units 2A, 2B, 2C, and 2D, in which an image is formed on the back side, and is then delivered to the outside.

Meanwhile, the photosensitive member 5 still continues to rotate after being away from the transfer belt 3*a,* and is then applied with a lubricant scraped by the brush-shaped roller 17*a* from the molded lubricant 17. When cleaned with the cleaning blade 15*a,* the lubricant applied onto the photosensitive member 5 is pressed to the photosensitive member 5 to form a layer on the surface of the photosensitive member 5.

Thereafter, the image forming process described above is repeated. Since the lubricant layer formed on the photosensitive member 5 is extremely thin, the layer does not inhibit charging by the charging device 14. Then, the toner image again developed on the photosensitive member 5 is transferred to the transfer paper P being attached to the transfer belt 3*a*.

In the image forming apparatus described above, when the photosensitive member unit 2 is brand new, no lubricant is present on the surface of the photosensitive member 5. Also, the solid molded lubricant 17*b* has been processed so as not to be prone to lose its shape, and therefore has a hardened surface. It takes some time until the hardened layer on the surface is removed.

Figure 3:
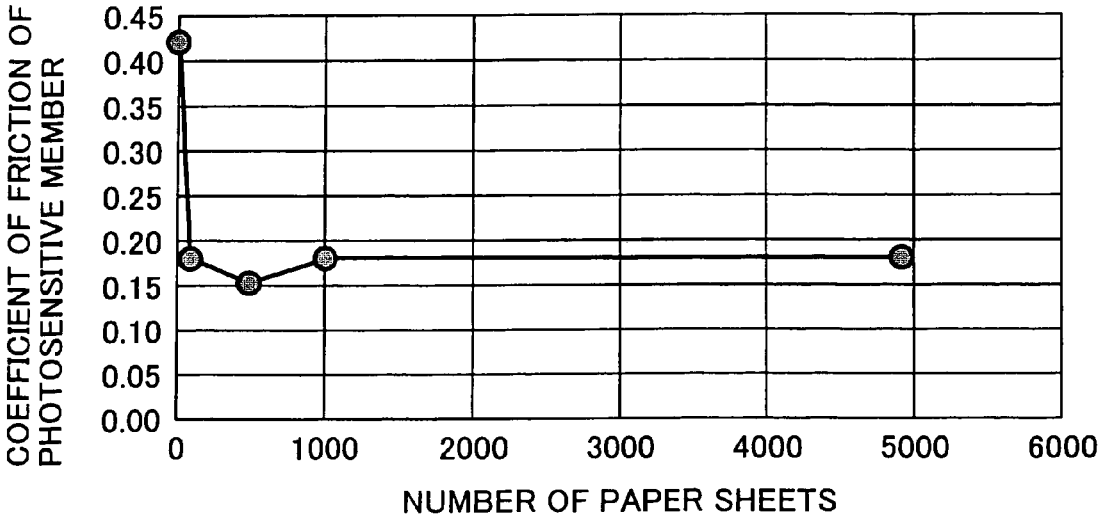
FIG. 3 is a graph for illustrating a relation between the number of paper sheets and a coefficient of friction of the photosensitive member unit.

FIG. 3 is a graph showing a relation between the number of paper sheets and a coefficient of friction of the photosensitive member unit 5 in a brand-new state with no lubricant applied thereto when 5000 A4-size sheets are fed with an image at an image area ratio of 5%. The coefficient of friction of the brand-new photosensitive member is of the order of 0.4. After feeding is started, the coefficient of friction is decreased until approximately 100 sheets are fed, and then is saturated at 0.2 or lower. As can been seen, the coefficient of friction of the photosensitive member 5 is reduced at the start of feeding because the hardened layer of the solid lubricant 17*b* is scraped.

In particular, as is the case with the image forming apparatus according to the present invention, when a toner whose average roundness is high is used, a large coefficient of friction of the photosensitive member 5 increases an attachment force between the surface of the photosensitive member 5 and the toner, thereby making it difficult to perform cleaning. Thus, it is known that a small coefficient of friction of the photosensitive member 5 is advantageous in cleaning. Therefore, the coefficient of friction is preferably as small as possible immediately from the start of using the photosensitive member 5.

To achieve this, in the image forming apparatus according to the present invention, a detecting unit is provided to the apparatus body 1 for detecting whether the photosensitive member 5 is brand new. When detecting that the photosensitive member 5 is brand new, the detecting unit causes the coefficient of friction of the lubricant applying unit 17 to operate so as to decrease the coefficient of friction of the photosensitive member 5 before the image forming process is performed. As such a unit of detecting whether the photosensitive member 5 is brand new, for example, a mechanical unit may be used for the photosensitive member unit 2 shown in FIG. 2. Alternatively, a storage unit, such as an IC chip, is provided to the photosensitive member 5 or the photosensitive member unit 2 for detection.

Figure 4:
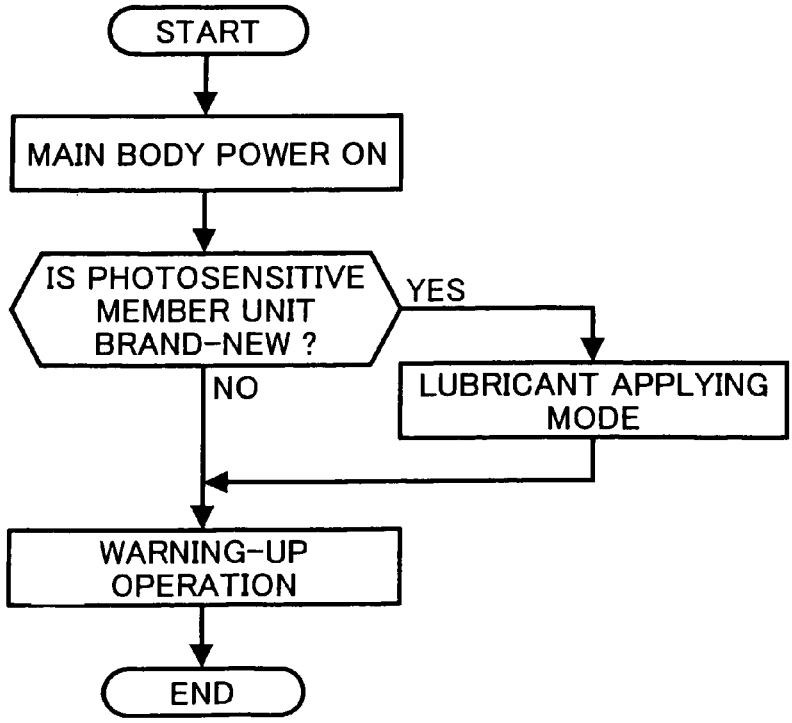
FIG. 4 is a flowchart of a lubricant applying mode in the present image forming apparatus.

FIG. 4 is a flowchart of the lubricant applying mode in the present image forming apparatus. The lubricant applying operation is performed in a manner such that a photosensitive driving motor is operated so as to cause the brush-shaped roller 17*a* to rotate for scraping the solid lubricant 17*b* and then applying it to the photosensitive member 5. At this time, preferably, the developing roller of the developing unit 10 and the transfer unit 3 are operated simultaneously at the same linear velocity, or they are separated from each other.

Figure 5:
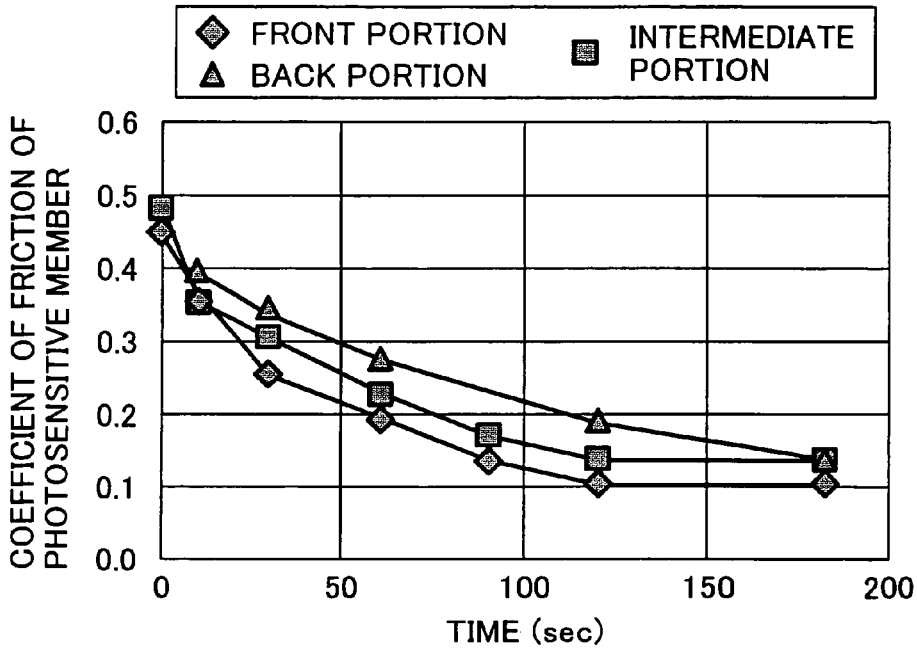
FIG. 5 is a graph showing a relation between a rotation time and the coefficient of friction of the photosensitive member unit when the photosensitive member unit is operated alone.

FIG. 5 shows a relation between a rotation time of the photosensitive member 5 and the coefficient of friction of the photosensitive member 5 (at three points) when the photosensitive member unit 2 is operated alone.

| | |
|---|---|
| Photosensitive member | |
| Diameter: | 30ϕ |
| Photosensitive member linear velocity: | 125 millimeters per second |
| Solid lubricant | |
| Material: | zinc stearate |
| Spring pressure force: | 1000 milliNewton |
| Brush-shaped roller | |
| Material: | conductive nylon |
| Density: | 30 KF/inch$^2$ |
| Thickness: | 10 D |
| Amount of engagement with photosensitive member: | 1.0 millimeter |

As evident from FIG. 5, the coefficient of friction of the photosensitive member 5 becomes 0.2 or lower in approximately 100 seconds. Therefore, under the condition described above, the lubricant applying operation is preferably performed for equal to or more than 100 seconds.

Also, a charging bias and a developing bias may be in an off state. However, to efficiently apply the lubricant to the photosensitive member 5 without attaching a toner onto the brush-shaped roller 17*a,* a surface potential may be applied to the photosensitive member 5 and the developing roller so as to prevent a taint on their surfaces that will cause a toner to be attached to the brush-shaped roller 17*a* during the lubricant applying operation.

Figure 6:
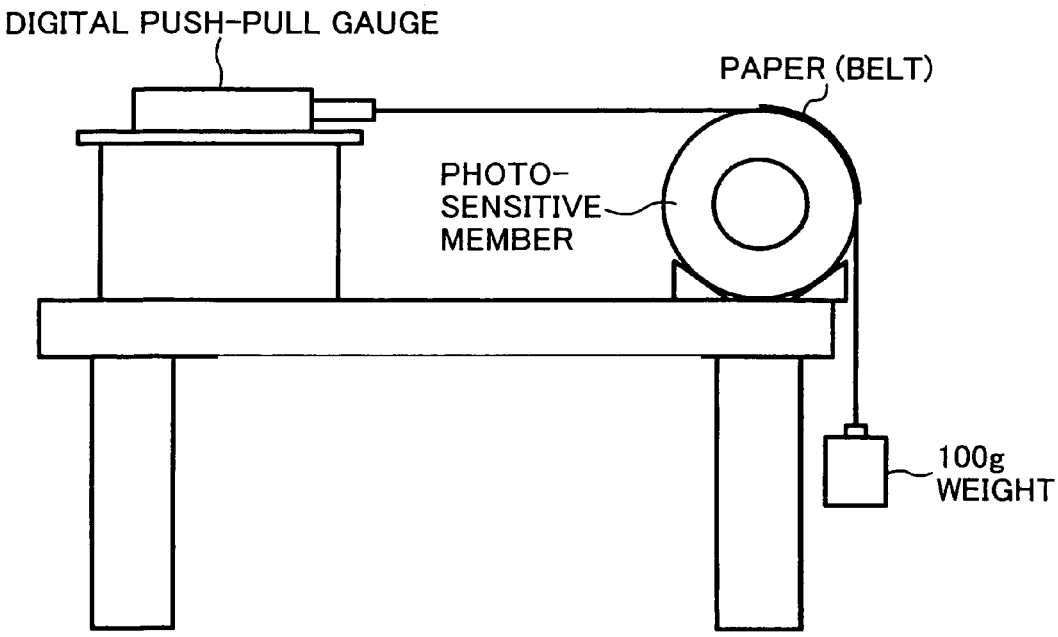
FIG. 6 is a diagram for explaining a scheme of measuring the coefficient of friction of the photosensitive member unit.

Here, the coefficient of friction of the photosensitive member 5 was measured in an Euler belt scheme. FIG. 6 is a diagram for explaining a scheme of measuring the coefficient of friction of the photosensitive member 5. In this case, as a belt, a bond paper sheet is extended in a longitudinal direction on one quarter of the circumference of a drum of the photosensitive member. Then, for example, a load of 0.98 Newton (100 grams) is applied at one end of the belt to pull a force gauge disposed at the other end thereof. Then, the value of the load when the belt is moved is read as a measurement value, and the measurement value is substituted into an equation of coefficient of friction $\mu s=2/\pi \cdot \ln(F/0.98)$, where $\mu$ is a coefficient of static friction and F is a measurement value. Note that the coefficient of friction of the photosensitive member 5 represents a steady-state value after image forming.

The coefficient of friction on the surface of the photosensitive member 5 after the lubricant applying operation is preferably 0.4 or lower and, more preferably, 0.2 or lower.

With the coefficient of friction being 0.4 or lower, the interaction between the photosensitive member 5 and the toner is reduced to cause the toner on the photosensitive member 5 to be easily removed, thereby increasing a transfer ratio. Also, the friction between the cleaning blade 15*a* and the photosensitive member 5 can be prevented from being increased, thereby increasing cleaning efficiency. This is particularly effective for reducing cleaning failures occurring due to a toner with a high roundness that is easy to roll on the photosensitive member 5. Furthermore, an increase in transfer rate reduces the amount of toner to be cleaned, thereby reducing the occurrence of cleaning failures over time. Meanwhile, when the coefficient of friction is lower than 0.1, the surface of the photosensitive member 5 is too slippery with respect to the cleaning blade 15*a,* and therefore cleaning failures occur such that the toner slips through the cleaning blade 15*a.*

Examples of the solid lubricant 17*b* are fatty acid metal salts, such as lead oleate, zinc oleate, copper oleate, zinc stearate, cobalt stearate, iron stearate, copper stearate, zinc palmitate, copper palmitate, and zinc linolenate, and fluororesin, such as polytetrafluoroethylene, polychlorotrifluoroethylene, vinylidene polyfluoride, polytrifluoroethylene, dichlorofluoroethylene, tetrafluoroethylene-ethylene copolymer, and tetrafluoroethylene-oxafluoropropylene copolymer. In particular, preferably, stearic metal salts, which have a large effect of reducing the friction of the photosensitive member 5, are used. More preferably, zinc stearate is used.

The amount of lubricant for application can be adjusted by a pressure to be applied to the pressure spring 17*d* that presses the solid lubricant 17*b* onto the brush-shaped roller 17*a*. In the present invention, the brush-shaped roller 17*a* is preferably pressed by the pressure spring with a pressure of equal to or more than 200 milliNewton including a self weight. As the pressure is increased, the amount of lubricant to be scraped by the brush-shaped roller 17*a* from the solid lubricant 17*b* is increased, thereby increasing the amount of lubricant to be applied to the photosensitive member 5 and decreasing the coefficient of friction of the photosensitive member 5.

The brush-shaped roller 17*a* is rotated in a direction identical to the rotating direction of the photosensitive member 5 in contact with the brush-shaped roller 17*a*. With the rotation in this direction, the lubricant attached to the brush-shaped roller 17*a* can be supplied to the photosensitive roller 5 with little impact. Here, no lubricant film is formed in advance at the time of supply from the brush-shaped roller 17*a* to the photosensitive member 5. The lubricant supplied onto the photosensitive member 5 is formed in a film shape by a press force from the cleaning blade 15*a*. Therefore, for supplying the lubricant with little impact, the brush-shaped roller 15*a* is preferably rotated in the direction identical to the rotating direction of the photosensitive member 5.

Furthermore, a circumferential velocity ratio between the brush-shaped roller 17*a* and the photosensitive member 5 (circumferential velocity of photosensitive member/circumferential velocity of the brush-shaped roller) is preferably in range of 0.8 to 1.2. If the circumferential velocity ratio is less than 0.8, the amount of supply of lubricant is small. If the ratio exceeds 1.2, an impact may damage the photosensitive member 5, thereby reducing the life of the photosensitive member 5. Furthermore, to supply the lubricant from the brush-shaped roller 17*a* to the photosensitive member 5 with a small impact, the circumferential velocity ratio is preferably in a range of 1.0 to 1.1.

In the present image forming apparatus, a smaller average particle diameter per volume Dv of the toner for use can improve the reproducibility of fine lines more. Therefore, a toner with equal to or less than 8 micrometers at the largest is used. However, a smaller particle diameter reduces cleaning ability. Therefore, at least 3 micrometers are preferred. Furthermore, if the diameter is less than 3 micrometers, toner particles of a fine diameter, which are not prone to be developed, are attached onto the surface of the magnetic carrier or the developing roller. Due to this, the contact or friction between other tones and the magnetic carrier or the development carrier becomes insufficient, thereby increasing reversely-charged toners. This produces abnormal images, such as ground fog, and therefore is not preferable.

Also, a particle diameter distribution represented by a ratio between the average particle diameter per volume Dv and an average particle diameter per number Dn (Dv/Dn) is preferably in a range of 1.00 to 1.40. By making the particle diameter sharpened, a toner-charge-amount distribution can be made uniform. When Dv/Dn exceeds 1.40, the toner-charge amount distribution becomes widened, thereby increasing reversely-charged toners. This makes it difficult to obtain a high-quality image. Here, the particle diameter of the toner is measured by using a Coulter counter multisizer (manufactured by Coulter Inc.), in which an aperture with a diameter of 50 micrometers is selected for measure correspondingly to the particle diameter of the toner to be measured, and measuring an average of the particle diameters of 50,000 particles.

Figure 7A:
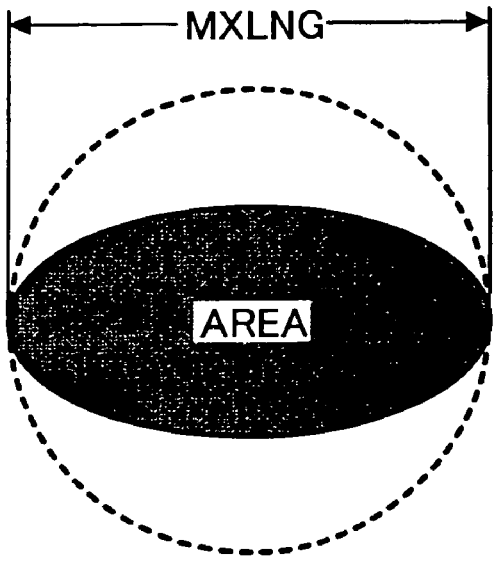
FIG. 7A is a diagram schematically showing a toner shape for explaining a shape factor SF-1.
Figure 7B:
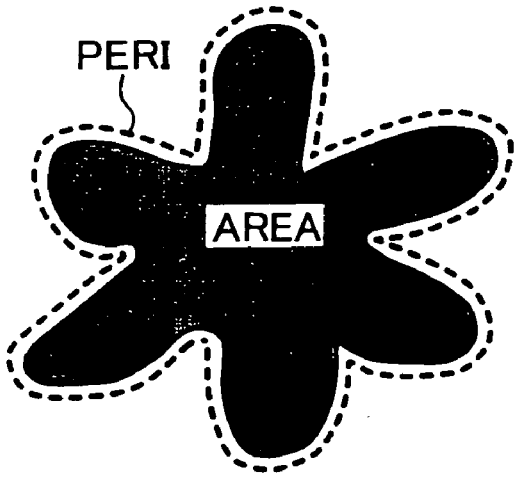
FIG. 7B is a diagram schematically showing a toner shape for explaining a shape factor SF-2.

Furthermore, the toner is preferably a toner that can be defined by the shape factors SF-1 and SF-2 described further below. FIGS. 7A and 7B are diagrams each schematically showing a toner shape, wherein FIG. 7A is a diagram for explaining the shape factor SF-1, while FIG. 7B is a diagram for explaining the shape factor SF-2.

The shape factor SF-1 indicates a ratio of roundness of the toner shape, and is expressed by a first equation shown below, in which a square of a maximum length MXLNG of the shape formed by projecting the toner onto a two-dimensional plane is divided by a graphic area AREA, and is then multiplied by 100π/4.

$$SF\text{-}1=\{(MXLNG)2/\mathrm{AREA}\}\cdot(100\pi/4) \quad (1)$$

When SF-1 is 100, the toner shape is spherical. As SF-1 is larger, the toner loses its shape more.

Meanwhile, the shape factor SF-2 indicates a ratio of a concave and a convex of the toner shape, and is expressed by second equation shown below, in which a square of a perimeter PERI of a graphic formed by projecting the toner onto a two-dimensional plane is divided by a graphic area AREA, and is then multiplied by 100π/4.

$$SF\text{-}2=\{(PERI)2/\mathrm{AREA}\}\cdot(100\pi/4) \quad (2)$$

When SF-2 is 100, no concave or convex are present on the surface of the toner. As SF-2 is larger, concaves and convex are more conspicuous.

The shape factors were calculated in a manner such that, specifically, the toner was photographed with a scanning electron microscope (S-800 manufactured by Hitachi, Ltd.), and the photographic image was introduced to an image analyzing apparatus (LUSEX3 manufactured by Nireco Corporation) for analysis.

In the toner according to the present invention, both the SF-1 and the SF-2 are in a range of 100 to 180. When the toner shape is closer to a ball shape, a contact among toners is a point contact, thereby reducing absorbability among toners and therefore increasing a fluidity thereamong. Also, absorbability between the toners and the photosensitive member 5 is also reduced, thereby increasing the transfer ratio. Meanwhile, the spherical toners are easy to fit in a space between the cleaning blades 15*a*. Therefore, the toner shape factors SF-1 and SF-2 are preferably large to a degree. However, if they are too large, the toners are scattered over the image, thereby degrading the image quality. Therefore, SF-1 and SF-2 preferably do not exceed 180.

The toner exemplarily used in the image forming apparatus according to the present invention is a toner obtained in a water-type solvent through either one or both of cross-linking reaction and elongating reaction of a toner material liquid obtained by dispersing polyester prepolymer polyester, a colorant, and a release agent each at least including a function of a nitrogen atom in an organic solvent. Hereinafter, components of the toner and a toner manufacturing scheme are described.

The toner according to the present invention includes polyester modified (i). Polyester modified (i) is in a state such that polyester resin includes a bond group other than that of ester bond, or such that polyester includes resin components of different structures being bonded through covalent bond or ion bond. Specifically, a function group, such as an isocyanate group, reacting with a carboxylic acid group and a hydroxyl group is introduced at a terminal of polyester. Furthermore, the resultant polyester is reacted with a compound including active hydrogen to form polyester modified at the terminal.

Examples of polyester modified are urea polyester modified obtained through reaction between polyester prepolymer (A) having an isocyanate group and amines (B). An example of polyester prepolymer (A) having an isocyanate group is condensation polymer of polyhydric alcohol (PO) and polyvalent carboxylate (PC) with polyester having an active hydrogen group further being reacted with a polyvalent isocyanate compound (PIC). Examples of the active hydrogen group included in the polyester are a hydroxyl group (alcoholic hydroxyl group and phenolic hydroxyl group), an amino group, a carboxyl group, and a mercapto group. Of these groups, the alcoholic hydroxyl group is preferable.

Examples of polyhydric alcohol (PO) are dihydric alcohol (DIO), and trihydric or higher alcohol (TO), and (DIO) alone or a mixture of (DIO) and a small amount of (TO) are preferable. Examples of dihydric alcohol (DIO) are alkylene glycol (such as ethylene glycol, 1,2-propylene glycol, 1,3-propylene glycol, 1,4-butanediol, 1,6-hexanediol); alkylene ether glycol (such as diethylene glycol, triethylene glycol, dipropylene glycol, polyethylene glycol, polypropylene glycol, and plytetramethylene ether glycol); alicyclic diol (such as 1,4-cyclohexanedimethanol and hydrogenerated bisphenol A), bisphenols (such as bisphenol A, bisphenol F, and bisphenol S); alkylene oxide additives (such as ethylene oxide, propylene oxide, and butylene oxide) of alicyclic diol stated above; and alkylene oxide additives (such as ethylene oxide, propylene oxide, and butylene oxide) of bisphenols stated above. Of these, alkylene glycol with a carbon number of 2 to 12 and alkylene oxide additives of biphenols are preferable. More preferable is a combination of alkylene oxide additives of biphenols and alkylene glycol with a carbon number of 2 to 12. Examples of trihydric or higher alcohol (TO) are polyhydric fatty alcohol of trivalent to octavalent or higher (such as glycerin, trimethylole ethane, trimethylolpropane, pentaerythritol, and sorbitol); trivalent or higher phenols (such as trisphenol PA, phenol novolac, and cresol novolac); and alkylene oxide additives of trivalent or higher polyphenols.

Examples of polyvalent carboxylate (PC) are divalent carboxylate (DIC), and trivalent or higher carboxylate (TC), and (DIC) alone or a mixture of (DIC) and a small amount of (TC) are preferable. Examples of divalent carboxylate (DIC) are alkylenedicarboxylate (such as sucinic acid, adipic acid, and sebacic acid); alkenylenedicarboxylate (such as maleic acid and fumaric acid); aromatic dicarboxylate (such as phthalic acid, isophthalic acid, terephthalic acid, and naphthalenedicarboxylate). Of these, alkylenedicarboxylate with a carbon number of 4 to 20 and aromatic dicarboxylate with a carbon number of 8 to 20. Examples of trivalent or higher carboxylate (TC) are aromatic polyvalent carboxylate with a carbon number of 9 to 20 (such as trimellitic acid and pyromellitic acid). Examples of polyvalent carboxylate (PC) are obtained by using acid anhydride of the above or lower alkyl ester (such as methyl ester and isopropyl ester) for reaction with polyhydric alcohol (PO).

As for a ratio of polyhydric alcohol (PO) and polyvalent carboxylate, an equivalent ratio [OH]/[COOH] between the hydroxyl group [OH] and the calboxyl group [COOH] is normally 2/1 to 1/1, preferably, 1.5/1 to 1/1, and more preferably, 1.3/1 to 1.02/1.

Examples of the polyvalent isocyanate compound (PIC) are aliphatic polyvalent isocyanate (such as tetramethylene isocyanate, hexamethylene isocyanate, and 2,6-diisocyanatomethyl caproate); alicyclic polyisocyanate (such as isophoronediisocyanate and cyclohexylmethane diisocyanate); aromatic diisocyanate (such as tolylenediisocyanate and diphenylmethane diisocyanate); aromatic aliphatic diisocyanate (such as $\alpha, \alpha, \alpha', \alpha'$-tetramethyl xylylene diisocyanate); isocyanates; a compound formed by blocking polyisocyanate described above with a phenol derivative, oxime, caprolactam, or the like; and a combination of at least two of these compounds.

As for a ratio of the polyvalent isocyanate compound (PIC), an equivalent ratio [NCO]/[OH] between the isocyanate group [NCO] and the hydroxyl group [OH] included in polyester is normally 5/1 to 1/1, preferably, 4/1 to 1.2/1, and more preferably, 2.5/1 to 1.5/1. If [NCO]/[OH] exceeds 5, low-temperature fixability is deteriorated. If a molar ratio of [NCO] is less than 1, when urea polyester modified is used, the amount of urea in that ester is low, thereby deteriorating the resistance to hot offset.

The amount of the polyvalent isocyanate compound (PIC) in polyesterprepolymer (A) having an isocyanate group is normally 0.5 weight-percent to 40 weight-percent, preferably, 1 weight-percent to 30 weight-percent, and more preferably, 2 weight-percent to 20 weight-percent. If the amount is less than 0.5 weight-percent, the resistance to hot offset is deteriorated. This is also disadvantageous in view of compatibility between heat resistance preservability and low-temperature fixability. Also, if the amount exceeds 40 weight-percent, the low-temperature fixability is deteriorated.

The number of isocyanate groups contained per molecule in polyesterprepolymer (A) having isocyanate groups is normally at least 1.0, preferably, 1.5 to 3, and more preferably, 1.8 to 2.5. If the number is less than 1, the amount of molecular weight of urea polyester modified is decreased, thereby deteriorating the resistance to hot offset.

Next, examples of amines (B) to be reacted with polyester prepolymer (A) are a divalent amine compound (B1), a trivalent or higher amine compound (B2), amino alcohol (B3), amino mercaptan (B4), amino acid (B5), and a compound (B6) obtained by blocking the amino group of B1 to B5.

Examples of the divalent amine compound (B1) are aromatic diamine (such as phenylenediamine, diethyltoluenediamine, and 4,4'-diaminodiphenylmethane); alicyclic diamine (such as 4,4'-diamino-3,3'-dimethyldicyclohexylmethane, diaminecyclohexane, and isophoronediamine); alophatic diamine (such as ethylenediamine, tetramethylenediamine, and hexamethylenediamine). Examples of the trivalent or higher amine compound (B2) are diethylenetriamine and triethylenetetramine. Examples of amino alcohol (B3) are ethanolamine and hydroxyethylaniline. Examples of amino mercaptan (B4) are aminoethylmercaptan and aminopropylmercaptan. Examples of amino acid (B5) are aminopropionic acid and aminocaproic acid. Examples of the compound (B6) obtained by blocking the amino group of B1 to B5 are a ketimine compound obtained from aminos and ketones (such as acetone, methyl ethyl ketone, and methyl isobutyl ketone) and an oxazolidine compound. Of these amines (B), preferable are B1 and a mixture of B1 and a small amount of B2.

As for a ratio of the amines (B), an equivalent ratio [NCO]/[NHx] between the isocyanate group [NCO] included in polyester prepolymer (A) having an isocyanate group and the amino group [NHx] included in the amines (B) is normally 1/2 to 2/1, preferably, 1.5/1 to 1/1.5, and more preferably, 1.2/1 to 1/1.2. If [NCO]/[NHx] exceeds 2 or is less than ½, the molecular weight of urea polyester modified is reduced, thereby deteriorating the resistance to hot offset.

Also, the urea polyester modified may contain a urethane bond as well as a urea bond. A molar ratio between the amount of urea bond and the amount of urethane bond is normally 100/0 to 10/90, preferably, 80/20 to 20/80, and more preferably, 60/40 to 30/70. If the molar ratio of the urea bond is less than 10 percent, resistance to hot offset is deteriorated.

Polyester modified (i) for use in the present invention is manufactured through a one-shot scheme or a prepolymer scheme. A weight-average molecular weight of polyester modified (i) is normally not less than 10000, preferably, 20000 to 10000000, and more preferably, 30000 to 1000000. At this time, a peak molecular weight is preferably 1000 to 10000. If the weight is less than 1000, and an elongating reaction is hard to occur, elasticity is low, thereby deteriorating resistance to hot offset. Meanwhile, if the weight exceeds 10000, the fixability is decreased and manufacturing problems in particle formation and pulverization become complex. A number-average molecular weight of polyester modified (i) is not particularly restrictive when polyester unmodified (ii), which will be described further below, is also used, and may be any that allow the weight-average molecular weight to be easily obtained. If (i) alone is used, the number-average molecular weight is normally not more than 20000, preferably, 1000 to 10000, and more preferably, 2000 to 8000. If the amount exceeds 20000, the low-temperature fixability and gloss that can be achieved when the toner is used for a full-color apparatus is deteriorated.

In either one or both of cross-linking reaction and elongating reaction between polyester prepolymer (A) and amines (B) for obtaining polyester modified (i), an inhibitor is used as required to adjust the molecular weight of urea polyester modified to be obtained. Examples of the inhibitor are monoamine (such as diethylamine, dibutylamine, butylamine, and laurylamine) and a compound obtained by blocking these amines (such as a ketimine compound).

In the present invention, only polyester modified (i) as described above can be used alone, and also this (i) can be used with polyester unmodified (ii) being included as a binder resin component. In combination with (ii), gloss is improved when the toner is used for a full-color apparatus having low-temperature fixability. This is preferable compared with the case of using (i) alone. Examples of (ii) are similar to those of polyester components of (i) described above, such as condensation polymer of polyhydric alcohol (PO) and polyvalent carboxylate (PC), and preferable examples are also similar to those of (i). Also, (ii) are not only polyester non-modified, but also polyester modified through a chemical bond other than a urea bond, such as polyester modified through a urethane bond. Preferably, (i) and (ii) are at least partially compatible with each other in view of low-temperature fixability and resistance to hot offset. Therefore, the polyester components of (i) and (ii) are preferably similar in composition to each other. A weight ratio between (i) and (ii) when (ii) is included is normally 5/95 to 80/20, preferably, 5/95 to 30/7, more preferably, 5/95 to 25/75, and particularly preferably, 7/93 to 20/80. If the weight ratio of (i) is less than 5 percent, resistance to hot offset is deteriorated. This is also disadvantageous in view of compatibility between heat resistance preservability and low-temperature fixability.

A peak molecule weight of (ii) is normally 1000 to 10000, preferably, 2000 to 8000, and more preferably, 2000 to 5000. If the weight is less than 1000, heat resistance presevability is deteriorated. If the weight exceeds 10000, low-temperature fixability is deteriorated. The hydorxyl value (ii) is preferably equal to or more than 5, more preferably, 10 to 120, and particularly preferably, 20 to 80. The value less than 5 is disadvantageous in view of compatibility between heat resistance preservability and low-temperature fixability. The acid value of (ii) is preferably 1 to 5, and more preferably, 2 to 4. Since high-acid-value wax is used, a low-acid value binder is easy to match with the toner for use in a two-component-system developer because such a binder leads to charging and a high-volume resistance.

A glass transition point (Tg) of binder resin is normally at 35° C. to 70° C., and preferably at 55° C. to 65° C. If the point is at less than 35° C., heat resistance preservability of the toner is deteriorated. If the point is at a temperature exceeding 70° C., low-temperature fixability is insufficient. Since urea polyester modified is prone to be present on the surfaces of toner main particles obtained, the toner according to the present invention shows a tendency to have an excellent heat resistance preservability even the glass transition point is low, compared with the known polyester toner.

As a colorant, any known dyes and pigments can be used. Examples are carbon black, nigrosine dye, iron black, naphthol yellow S, Hansa yellow (10G, 5G, G), cadmium yellow, yellow iron oxide, ocher, chrome yellow, titanium yellow, polyazo yellow, oil yellow, Hansa yellow (GR, A, RN, R), pigment yellow L, benzidine yellow (G, GR), permanent yellow (NCG), Vulcan fast yellow (5G, R), tartrazine lake, quinoline yellow lake, "ansurazan" yellow BGL, isoindolinone yellow, colcothar, red lead, vermilion lead, cadmium red, cadmium mercury red, antimony vermilion, permanent red 4R, para red, "faise" red, parachlorortho nitoroaniline red, lithol fast scarlet G, brilliant fast scarlet, brilliant carmine BS, permanent red (F2R, F4R, FRL, FRLL, F4RH), fast scarlet VD, Vulcan Fast Rubine B, brilliant scarlet G, Lithol Rubine GX, permanent red F5R, brilliant carmine 6B, pigment scarlet 3B, Bordeaux 5B, toluidine maroon, permanent Bordeaux F2K, Helio Bordeaux BL, Bordeaux 10B, BON maroon light, BON maroon medium, eosin lake, rhodamine lake B, rhodamine lake Y, alizarine lake, thioindigo red B, thioindigo maroon, oil red, quinacridone red, pyrazolone red, polyazo red, chrome vermilion, benzidine orange, "perinon" orange, oil orange, cobalt blue, cerulean blue, alkali blue lake, peacock blue lake, victoria blue lake, organic phthalocyanine blue, phthalocyanine blue, fast sky blue, indanthrene blue (RS, BC), indigo, ultramarine, Prussian blue, anthraquinone blue, fast violet B, methyl violet lake, cobalt violet, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, hydrozincite, "ritobon" and mixtures thereof. The amount of colorant with respect to the toner is normally 1 weight-percent to 15 weight-percent, and preferably, 3 weight-percent to 10 weight-percent.

The colorant can be used as a masterbatch combined with resin. Examples of binder resin for use in manufacturing a masterbatch or binder resin mixed with a masterbatch are styrenes, such as polystyrene, poly-p-chlorostyrene, and polyvinyl toluene and polymer of their substitution products, or copolymer of styrenes mentioned above and vinyl compounds, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic resin, rosin, rosin modified, terpene resin, aliphatic or alicyclic hydrocarbon resin, aromatic petroleum resin, chlorinated paraffin, and paraffin wax. These exemplary binder resins can be used alone or in combination.

As an electric charge control agent, any known such agents can be used. Examples are nigrosine dye, triphenylmethane dye, chrome-containing metal complex dye, chelate molybdate pigment, rhodamine dye, alkoxy amine, quaternary ammonium salt (including fluorine-modified quaternary ammonium salt), alkylamide, phosphorus simple substance or its compound, tungsten simple substance or its compound, fluorine activator, salicylate metal salt, and salicylate delivative metal salt. Specifically, Bontron 03 of nigrosine dye, Bontron P-51 of quaternary ammonium salt, Bontron S-34 of metal-containing azo dye, E-82 of oxynaphthoic acid metal complex, E-84 of salicylate metal complex, and E-89 of phenol condensate (which are manufactured by Orient Chemical Industries, Ltd.); TP-302 and TP-415 of quaternary ammonium salt molybdenum complex (which are manufactured by Hodogaya Chemical Co., Ltd.); copy charge PSY VP2038 of quaternary ammonium salt, copy blue PR of a triphenylmethan derivative, and copy charge NEG VP2036 and copy charge NX VP434 (which are manufactured by Hoechst AG); LRA-901, LR-147 of boron complex (which is manufactured by Japan Carlit Co., Ltd.), copper phthalocyanine, perylene, quinacridon, azo pigment, and high polymer compounds having a functional group, such as a sulfonic acid group, a carboxyl group, and a quaternary ammonium salt group. Of these, a substance negatively controlling the toner is particularly preferable for use.

The amount of use of electric charge control agent is determined depending on the toner manufacturing scheme, including the type of the binder resin, the presence or absence of an additive for use as required, and the dispersion scheme, and therefore cannot be uniquely defined. Preferably, the binder resin is used in an amount of 0.1 part-by-weight to 10 parts-by-weight per 100 parts-by-weight of binder resin. A preferable range is 0.2 part-by-weight to 5 parts-by-weight. When the amount exceeds 10 parts-by-weight, the electric charge of the toner is too large, thereby reducing the effect of the electric charge control agent and increasing electrostatic attraction with the development roller. This reduces fluidity of a development agent and image density.

As a release agent, low-melting wax with a melting point of 50° C. to 120° C. is used to operate between the fixing roller and the toner interface more effectively as a release agent in dispersion with binder resin. This is effective to high-temperature offset without requiring a release agent, such as oil, to be applied to the fixing roller. Examples of such a wax component are as follows. As waxes, examples are vegetable wax, such as carnauba wax, cotton wax, wood wax, and rice wax; animal wax, such as bees wax and lanolin; mineral wax, such as ozokerite and selsyn; and petroleum wax, such as parafiin, microcrystalline and petrolatum. Also, other than the natural wax, examples are synthetic hydrocarbon wax, such as Fischer-Tropsch wax and polyethylene wax; and synthetic wax, such as ester, ketone, and ether. Furthermore, crystalline polymer having a long alkyl group in a side chain can also be used, such as fatty amide, such as 12-hydroxystearamide, stearamide, phthalic anhydride imide, and chlorinated hydrocarbon; and crystalline polymer resin of a low molecular weight, such as poly-n-stearyl methacrylate; homopolymer of polyacrylate, such as poly-n-lauryl methacrylate, or its copolymer (for example, n-stearyl acrylate-ethyl methacrylate).

The electric charge control agent and the release agent can be melted and mixed with masterbatch and binder resin, or, as a matter of course, can be added when being dissolved and dispersed in organic solvent.

As an external additive for helping fluidity, development ability, electrostatic property of the toner particles, inorganic fine particles are preferably used. The diameter of a primary particle of such inorganic fine particles is preferably $5\times10^{-3}$ micrometer to 2 micrometers, and particularly, $5\times10^{-3}$ micrometer to 0.5 micrometer. Also, a specific surface through the BET scheme is preferably 20 $m^2/g$ to 500 $m^2/g$. A ratio of use of the inorganic fine particles is preferably 0.01 weight-percent to 5 weight-percent with respect to the toner, and particularly, 0.01 weight-percent to 2.0 weight-percent.

Specific examples of inorganic fine particles are, for example, silica, alumina, titanium oxide, barium titanate, magnesium titanate, calcium titanate, strontium titanate, zinc oxide, tin oxide, silica sand, clay, mica, wollastonite, diatomaceous earth, chromic oxide, ceric oxide, colcothar, antimonic troxide, magnesium oxide, zirconium oxide, barium sulfate, barium carbonate, calcium carbonate, silicon carbide, and silicon nitride. Of these, as a liquid additive, a combination of hydrophobic silica fine particles and hydrophobic titanium oxide fine particles is preferable. Particularly when these fine particles with an average particle diameter of $5\times10^{-2}$ micrometer or less are shaken and mixed for use, an electrostatic force with the toner and a Van der Waals force are significantly improved. Therefore, even with shaking and mixing inside the developing device being performed for obtaining a desired charge level, the liquid additive can be prevented from being detached from the toner. Thus, high image quality without firefly and reduction in transfer residual toner can be achieved.

Titanium oxide fine particles are excellent in environmental stability and image density stability, but tend to be deteriorated in charging startup characteristics. Therefore, when the amount of addition of titanium oxide fine particles is larger than the amount of addition of silica fine particles, such a side effect may be large. However, the amount of addition hydrophobic silica fine particles and the amount of addition of hydrophobic titanium oxide fine particles are in a range of 0.3 weight-percent to 1.5 weight-percent, the charging startup characteristics are not so impaired, and desired charging startup characteristics can be obtained. That is, even with repeated copying, stable image quality can be achieved.

Other than the above, a lubricant may be externally added to the toner. Examples of the lubricant externally added to the toner are fine particles of aliphatic metal salt, such as zinc stearate, and fluororesin, such as polytetrafluoroethylene. With the toner also being added with a lubricant, when a residual transfer toner on the photosensitive member 5 is cleaned by the cleaning blade 15*a*, the toner is pressed to a side of the photosensitive member 5. Then, the lubricant on the surface of the toner is extended together with the lubricant supplied onto the photosensitive member 5 from the lubricant applying unit 17 to form a thin film on the surface of the photosensitive member 5. For example, when an image with a high image area ratio is formed, a large amount of toner remains on the brush-shaped roller 17*a* of the lubricant applying unit 17. Therefore, the solid lubricant 17*b* is not sufficiently scraped. Further, the lubricant supplied onto the photosensitive member 5 is attached to the toner to be lost, thereby making the amount of supply of the lubricant onto the photosensitive member 5 uneven. With the toner also being added with a lubricant, such problems can be eliminated.

Next, a toner manufacturing scheme is described. Here, a preferable manufacturing scheme is described, but this is not meant to be restrictive.

(1) A colorant, polyester unmodified, polyester prepolymer having an isocyanate group, and a release agent are dispersed in an organic solvent to make a toner material liquid.

The organic solvent is preferably volatile with a boiling point of lower than 100° C. because it is easy to remove after forming toner main particles. Specifically, examples are toluene, xylene, benzene, carbon tetrachloride, methylene chloride, 1,2-dichloroethane, 1,1,2,-trichloroethane, trichloroethylene, chloroform, monochlorobenzene, dichloroethylidene, methyl acetate, ethyl acetate, methyl ethyl ketone, and methyl isobutyl ketone alone or in combination of two or more. Particularly preferable are an aromatic solvent, such as toluene and xylene; and halogenated hydrocarbon, such as methylene chloride, 1,2-dichloroethane, chloroform, and carbon tetrachloride. The organic solvent is normally used in an amount of 0 part-by-weight to 300 parts-by-weight, preferably, 0 part-by-weight to 100 parts-by-weight, and more preferably, 25 parts-by-weight to 70 parts-by-weight per 100 parts-by-weight of polyester prepolymer.

(2) The toner material liquid is emulsified in a water solvent under the presence of a surface-active agent and resin fine particles.

The water solvent may be water alone, or may include an organic solvent, such as alcohol (such as methanol, isopropyl alcohol, and ethylene glycol), dimethylformamide, tetrahydrofuran, cellosolves (such as cellosolvemethyl), and lower ketones (such as acetone and methyl ethyl ketone).

The water solvent is normally used in an amount of 50 parts-by-weight to 2000 parts-by-weight, and preferably, 100 parts-by-weight to 1000 parts-by-weight per 100 parts-by-weight of the toner material liquid. If the amount is less than 50 parts-by-weight, the state of dispersion of the toner material liquid is unsatisfactory, and toner particles with a desired particle diameter cannot be obtained. The amount exceeding 20000 parts-by-weight is not economical.

Also, to make the state of dispersion in the water solvent satisfactory, a dispersant, such as a surface-active agent and resin fine particles, is added as appropriate.

Examples of the surface-active agent are an anionic surface-active agent, such as alkylbenzene sulfonate, α-olefin sulfonate, and phosphoric ester; a cationic surface-active agent of amine salt type, such as alkylamine salt, an amino alcohol fatty acid derivative, polyamine alcohol fatty acid derivative, and imidazoline, and of quaternary ammonium salt type, such as alkyltrimethyl ammonium salt, dialkyldimethyl ammonium salt, alkyldimethylbenzyl ammonium salt, pyridinium salt, alkylisoquinolinium salt, and benzethonium chloride; a nonionic surface-active agent, such as a fatty amide derivative and polyhydric alcohol; and an amphoteric surface-active agent, such as alanine, dodecyldi(aminoethyl) glycine, di(octylaminoethyl)glycine, and N-alkyl-N,N-dimethyl ammonium betaine.

Also, with the use of a surface-active agent having a fluoroalkyl group, only an extremely small amount of such an agent can achieve an effect. Examples of an anionic surface-active agent having a fluoroalkyl group are fluoroalkylcarboxylate with a carbon number of 2 to 10 and its metal salt, perfluoro octanesulfonyl disodium glutamate, 3-[ω-fluoroalkyl (C6 to C11) oxy]-1-alkyl (C3 to C4) sulfonic acid sodium, 3-[ω-fluoroalkanoyl (C6 to C8)-N-ethylamino]-1-propanesulfonic acid sodium, fluoroalkyl (C11 to C20) carbonxylate and its metal salt, perfluoroalkyl carbonxylate (C7 to C13) and its metal salt, perfluoroalkyl (C4 to C12) sulfonic acid sodium and its metal salt, perfluorooctane sulfonic acid diethanolamide, N-proplyl-N-(2-hydroxyethyl) perfluorooctansulfonamide, perfluoroalkyl (C6 to C10) sulfonamidepropyltrimethyl ammonium salt, perfluoroalkyl (C6 to C10)-N-ethylsulfonylglycin salt, and monoperfluoroalkyl (C6 to C16) ethylphosphoric ester.

Examples of trade names are Sarfron S-111, S-112, and S-113 (manufactured by Asahi Glass Co., Ltd.), Frorard FC-93, FC-95, FC-98, and FC-129 (manufactured by Sumitomo 3M Limited), Unidyne DS-101 and DS-102 (manufactured by Daikin Industries, Ltd), Megafac F-110, F-120, F-113, F-191, F-812, and F-833 (manufactured by Dainippon Ink and Chemicals, Inc.), "EFTOP" EF-102, 103, 104, 105, 112, 123A, 123B, 306A, 501, 201, and 204 (manufactured by Tohkem Products Co.), and Ftergent F-100 and F150 (manufactured by Neos Co.)

Also, examples of a cationic surface-active agent are primary or secondary aliphatic, or secondary amine acid with a fluoroalkyl group at right, aliphatic quaternary ammonium salt, such as perfluoroalkyl (C6-C10) sulfonamidepropyltrimethylammonium, pyridinium salt, and imidazolynium salt. Examples of brand names are Sarfron S-121 (manufactured by Asahi Glass Co., Ltd.), Frorard FC-135 (manufactured by Sumitomo 3M Limited), Unidyne DS-202 (manufactured by Daikin Industries, Ltd), Megafac F-150 and F824 (manufactured by Dainippon Ink and Chemicals, Inc.), "EFTOP" EF-132 (manufactured by Tohkem Products Co.), and Ftergent F-300 (manufactured by Neos Co.)

Resin fine particles are added so as to stabilize the toner main particles formed in the water solvent. To achieve this, resin fine particles are preferably added so that an applying ratio on the surface of a toner main particle is in a range of 10% to 90%. Examples are polymethyl methacrylate fine particles of 1 micrometer or 3 micrometers, polystyrene fine particles of 0.5 micrometer or 2 micrometers, and poly(styrene-acrylonitrile) fine particles of 1 micrometer. Examples of brand names are PB-200H (manufactured by Kao Co.), SGP (manufactured by Soukensha), Techpolymer SB (manufactured by Sekisui Plastics Co., Ltd), and SGP-3G (manufactured by Souken), and Micropearl (manufactured by Sekisui Fine Chemicals Division).

Also, inorganic compound dispersants can be used, such as tricalcium phosphate, calcium carbonate, titanium oxide, colloidal silica, and hydroxyapatite.

In combination with the resin fine particles and inorganic compound dispersants, dispersants with dispersed drops stabilized with high polymer protective colloid can be used. For example, (meta) acrylic monomer including acids, such as acrylic acid, methacrylic acid, α-cyanoacrylic acid, α-cyanomethacrylic acid, itacoic acid, crotonic acid, fumaric acid, maleic acid, or maleic anhydride, or a hydroxyl group, can be used. Examples of such (metha) acrylic monomer are acrylic acid-β-hydroxyethyl, methacrylic acid-β-hydroxyethyl, acrylic acid-β-hydroxypropyl, methacrylic acid-β-hydroxypropyl, acrylic acid-γ-hydroxypropyl, methacrylic acid-γ-hydroxypropyl, acrylic acid-3-chloro-2-hydroxypropyl, methacrylic acid-3-chloro-2-hydroxypropyl, diethylene glycol monoacrylic ester, diethylene glycol monomethacrylic ester, glyceric monoacrylic ester, glyceric monomethacrylic ester, N-methylol acrylic amide, and N-methylol methacrylic amide. Also, vinyl alcohol or ethers with or vinyl alcohol can be used. Examples of such ethers are vinyl methyl ether, vinyl ethyl ether, and vinyl propyl ether. Also, esters including a vinyl alcohol and a carboxyl group can be used. Examples of such esters are vinyl acetate, vinyl propionate, and vinyl butyrate. Furthermore, examples of dispersants are acrylamide, methacrylamide, diacetone acrylamide, and their methylol compounds; chloride acids, such as acrylic chloride and methacrylic chloride; nitrogen-containing compounds, such as vinylpyridine, vinylpyrrolidone, vinylimidazole, and ethyleneimine, and their heterocyclic homopolymer and copolymer; polyoxyethylenes, such as polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenylester, and polyoxyethylene nonylphenylester; and celluloses, such as methyl cellulose, hydroxyethylcellulose, and hydroxypropylcellulose.

A dispersing scheme is not particularly restrictive. For example, known dispersing facilities of low-speed shearing type, high-speed shearing type, friction type, high-pressure jet type, and ultrasonic type can be applied. Of these, the high-speed shearing facility is preferable for obtaining a particle diameter of a dispersing element of 2 micrometers to 20 micrometers. When the high-speed shearing facility is used, the rotation speed is not particularly restrictive, but is normally at 1000 revolutions per minute to 30000 revolutions per minute, and preferably, at 5000 revolutions per minute to 20000 revolutions per minute. A dispersing time is not particularly restrictive but, in a batch scheme, is normally 1 minute to 5 minutes. The temperature at the time of dispersion is normally 0° C. to 150° C. (under pressure), and preferably, 40° C. to 98° C.

(3) When emulsified liquid is formed, amines (B) is simultaneously added for reaction with polyester prepolymer (A) having an isocyanate group.

This reaction accompanies either one or both of cross-linking reaction and elongating reaction of a molecular chain. A reaction time is selected depending on the structure of the isocyanate group included in the polyester prepolymer (A) and reactivity with amines (B), and is normally 10 minutes to 40 hours, and preferably, 2 hours to 24 hours. A reaction temperature is normally 0° C. to 150° C., and preferably 40° C. to 98° C. Also, known catalyst can be used as required. Specifically, dibutyltinlaurate and dioctyltinlaurate can be used.

(4) After reaction is over, the organic solvent is removed from the emulsified dispersion (reactant). Then, cleaning and drying are performed to obtain toner main particles.

To remove the organic solvent, the entire system is gradually heated in a laminar mixing state. In a predetermined temperature range, the reactant is strongly mixed, and then the solvent is removed, thereby forming fusiform toner main particles. Also, when calcium phosphate, which is a substance dissolvable in acid or alkaline is used as a dispersion stabilizer, for example, calcium phosphate is dissolved in acid, such as hydrochloric acid, and then water cleaning is performed, for example to remove the calcium phosphate from the toner main particles. Other than that, removal can also be achieved through decomposition with enzyme.

(5) An electric charge control agent is implanted to the toner main particles obtained in the manner described above. Then, inorganic fine particles, such as silica fine particles or titanium oxide fine particles, are externally added, thereby obtaining a toner. Implantation of the electric charge control agent and external addition of the inorganic fine particles are preformed through a know scheme using a mixer or the like.

With this, a toner with a small particle diameter and a sharp particle diameter distribution can be easily obtained. Furthermore, with strong mixing in the process of removing the organic solvent, the particle shape can be controlled between a spherical shape and a rugby-ball shape. Furthermore, the morphology of the surface is also controlled between a smooth shape and a rough shape.

Also, the particle of the toner for use in the developing unit has an approximately spherical shape defined as described below.

Figure 8A:
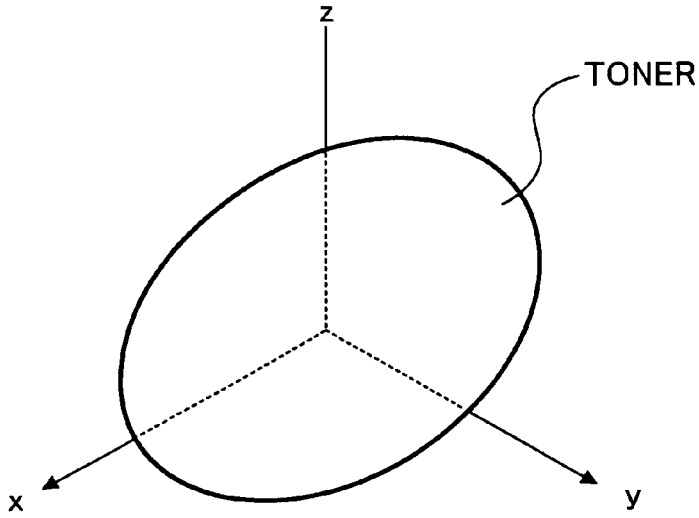
FIGS. 8A, 8B, and 8C are diagrams schematically showing toner shapes according to the present invention.
Figure 8B:
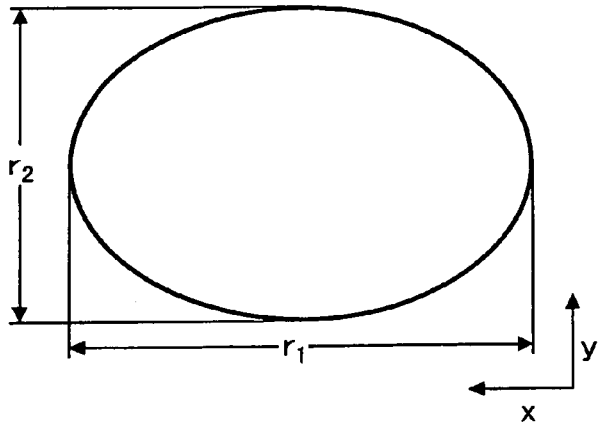
Figure 8C:
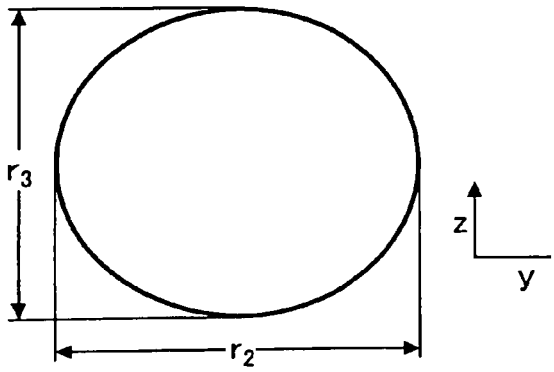

FIGS. 8A through 8C are diagrams schematically showing the toner shapes according to the present invention. When the particle of the toner having an approximately spherical shape is defined by a major axis r1, a minor axis r2, and a thickness r3 where r1≧r2≧r3, the toner according to the present invention preferably has a ratio between the major axis r1 and the minor axis r2 (r2/r1) (see FIG. 8B) in a range of 0.5 to 1.0, and a ratio between the thickness r3 and the minor axis r2 (r3/r2) (see FIG. 8C) in a range of 0.7 to 1.0. If the ratio between the major axis and the minor axis (r2/r1) is less than 0.5, the toner particle loses its spherical shape, thereby degrading the dot reproducibility and transfer efficiency. In this case, a high-quality image cannot be obtained. Also, if the ratio between the thickness and the minor axis (r3/r2) is less than 0.7, the toner particle has a shape close to a flat shape. Therefore, a high transfer rate as in a spherical toner cannot be achieved. Particularly, if the ratio between the thickness and the minor axis (r3/r2) is 1.0, the toner particle becomes a rotator with its main axis being taken as a rotational axis, thereby improving a fluidity of toners.

Note that r1, r2, and r3 were photographed with a scanning electron microscope (SEM) at different viewing angles and measured while being observed.

The present invention can also be applied to a process cartridge in which a photosensitive member as an image carrier for carrying a latent image and at least one unit selected from for carrying a latent image, a charging device, a developing device, and a cleaning device are integrally supported, the process cartridge being formed so as to be removable from a body of an image forming apparatus. The process cartridge according to the present invention is formed so as to include, in addition to the devices mentioned above, a lubricant applying unit provided with a solid lubricant and a brush-shaped roller for scraping the solid lubricant by sliding the brush-shaped roller and applying the solid lubricant to the surface of the image carrier. When a detecting unit provided to the body of the image forming apparatus detects that the process cartridge is brand new, the lubricant applying unit is operated. With this, the coefficient of friction can be small from the start of using the process cartridge, thereby increasing the ability of cleaning on the surface of the photosensitive member to extend its life. Also, when maintenance is required, only the process cartridge is replaced, which enhances convenience.

In the image forming apparatus according to the present invention, by eliminating variations in state of presence of a lubricant on a photosensitive member that are caused by variations in state of an image, such as a monochrome image or a full-color image, depending on an image forming mode or by variations in image area ratio are eliminated, a stable cleaning ability can be achieved at a cleaning unit using a cleaning blade.

Also, in the process cartridge according to the present invention, a unit of applying a lubricant is provided. Also, the process cartridge is used for an image forming apparatus using a lubricant. Thus, variations in state of presence of the lubricant on the photosensitive member that are caused by variations in state of the image or by variations in image area ratio can be eliminated, thereby achieving a stable cleaning ability.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus, comprising:

a photosensitive unit body detachably mounted to the image forming apparatus, the photosensitive unit body including a charging unit, an image carrier, a cleaning unit, and a lubricant applying unit;

the image carrier, on which an electrostatic latent image is formed, configured to carry the latent image and supported on the photosensitive unit body;

the charging unit configured to charge the image carrier;

a latent image forming unit configured to form the latent image on the image carrier;

a developing unit configured to form a toner image on the image carrier;

a transferring unit configured to transfer the toner image to a recording medium;

the cleaning unit configured to clean toner remaining on the image carrier with a cleaning blade;

the lubricant applying unit supported on the photosensitive unit body, the lubricant applying unit including a solid lubricant and a brush-shaped roller and being configured to apply the solid lubricant to the surface of the image carrier by scraping the solid lubricant with the brush-shaped roller; and a detecting unit configured to detect whether the image carrier is brand new, wherein the lubricant applying unit is configured to operate when the detecting unit detects that the image carrier is brand new.

2. The image forming apparatus according to claim 1, wherein the lubricant applying unit is configured to operate when the detecting unit detects that the photosensitive unit body is brand new.

3. The image forming apparatus according to claim 1, wherein a coefficient of friction of the image carrier after a lubricant applying operation is performed is 0.4 or more.

4. The image forming apparatus according to claim 1, wherein the lubricant applying unit is configured to apply the solid lubricant that includes either a fatty acid metal salt or a fluororesin.

5. The image forming apparatus according to claim 1, wherein when scraping the solid lubricant, the lubricant applying unit presses the brush-shaped roller onto the solid lubricant by a pressure of 200 milliNewton or more.

6. The image forming apparatus according to claim 1, further comprising:

a driving unit configured to drive the image carrier and the brush-shaped roller such that a ratio of a circumferential velocity of the image carrier to a circumferential velocity of the brush-shaped roller is in a range of 0.8 to 1.2.

7. The image forming apparatus according to claim 1, wherein the developing unit includes a toner having an average roundness of 0.94 or more.

8. The image forming apparatus according to claim 7, wherein the developing unit is configured to form the toner image with the toner having an average particle diameter per volume in a range of 3 micrometers to 8 micrometers and a ratio of the average particle diameter per volume to an average particle diameter per number in a range of 1.00 to 1.40.

9. The image forming apparatus according to claim 7, wherein the developing unit is configured to form the toner image with the toner having both a shape fraction SF-1 and a shape fraction SF-2 in a range of 100 to 180.

10. The image forming apparatus according to claim 7, wherein the developing unit is configured to form the toner image with the toner that is obtained in a water-type solvent through either one or both of cross-linking reaction and elongating reaction of a toner material liquid obtained by dispersing polyester prepolymer polyester, a colorant, and a release agent, each of which having a functional group including a nitrogen atom, in an organic solvent.

11. The image forming apparatus according to claim 7, wherein the developing unit is configured to form the toner image with the toner having a particle that is an approximately spherical shape defined by a major axis r1, a minor axis r2, and a thickness r3, where $r1 \geqq r2 \geqq r3$, a ratio of the minor axis r2 to the major axis r1 being in a range of 0.5 to 1.0, and a ratio of the thickness r3 to the minor axis r2 being in a range of 0.7 to 1.0.

12. The image forming apparatus according to claim 1, wherein the lubricant applying unit is configured to remove a hardened layer on a surface of the solid lubricant, and to apply the solid lubricant to the surface of the image carrier after the hardened layer of the solid lubricant is removed, when the detecting unit detects that the image carrier is brand new.

13. The image forming apparatus according to claim 1, wherein the image carrier is a photosensitive drum.

14. A process cartridge configured to be detachably mounted on an image forming apparatus that includes a detecting unit configured to detect whether an image carrier supported on said process cartridge is brand new, said process cartridge comprising:

a process cartridge body;

said image carrier, on which an electrostatic latent image is formed, configured to carry the latent image;

a charging unit configured to charge the image carrier;

a latent image forming unit configured to form the latent image on the image carrier; and a lubricant applying unit including a solid lubricant and a brush-shaped roller, said lubricant applying unit being configured to apply said solid lubricant to said surface of said image carrier by scraping said solid lubricant with said brush-shaped roller, wherein said image carrier and said lubricant applying unit are supported on said process cartridge body, and said lubricant applying unit is configured to operate when the detecting unit detects that said image carrier is brand new.

15. The process cartridge according to claim 14, wherein the lubricant applying unit is configured to operate when the detecting unit detects that the process cartridge is brand new.

16. The process cartridge according to claim 14, wherein a coefficient of friction of the image carrier after a lubricant applying operation is performed is 0.4 or more.

17. The process cartridge according to claim 14, wherein the lubricant applying unit is configured to apply the solid lubricant that includes either a fatty acid metal salt or a fluororesin.

18. The process cartridge according to claim 14, wherein when scraping the solid lubricant, the lubricant applying unit presses the brush-shaped roller onto the solid lubricant by a pressure of 200 milliNewton or more.

19. The process cartridge according to claim 14, wherein the image carrier and the brush-shaped roller are configured to rotate with a ratio of a circumferential velocity of the image carrier to a circumferential velocity of the brush-shaped roller in a range of 0.8 to 1.2.

20. The process cartridge according to claim 14, further comprising:

the charging unit configured to charge the image carrier by bringing a charging member in contact with or close to a surface of the image carrier;

a developing unit configured to develop the latent image by transporting toner configured to adhere to the latent image and form a toner image on the image carrier; and a cleaning unit configured to clean toner remaining on the image carrier with a cleaning blade.

21. The process cartridge according to claim 20, wherein the developing unit is configured to develop the latent image by transporting the toner having an average particle diameter per volume in a range of 3 micrometers to 8 micrometers and a ratio of the average particle diameter per volume to an average particle diameter per number in a range of 1.00 to 1.40.

22. The process cartridge according to claim 20, wherein the developing unit is configured to develop the latent image by transporting the toner having both a shape fraction SF-1 and a shape fraction SF-2 of the toner are in a range of 100 to 180.

23. The process cartridge according to claim 20, wherein the developing unit is configured to develop the latent image by transporting the toner that is obtained in a water-type solvent through either one or both of cross-linking reaction and elongating reaction of a toner material liquid obtained by dispersing polyester prepolymer polyester, a colorant, and a release agent, each of which having a functional group including a nitrogen atom, in an organic solvent.

24. The process cartridge according to claim 20, wherein the developing unit is configured to develop the latent image by transporting the toner having a particle that is an approximately spherical shape defined by a major axis r1, a minor axis r2, and a thickness r3, where r1≧r2≧r3, a ratio of the minor axis r2 to the major axis r1 being in a range of 0.5 to 1.0, and a ratio of the thickness r3 to the minor axis r2 being in a range of 0.7 to 1.0.

25. The process cartridge according to claim 14, wherein the lubricant applying unit is configured to remove a hardened layer on a surface of the solid lubricant, and to apply the solid lubricant to the surface of the image carrier after the hardened layer of the solid lubricant is removed, when the detecting unit detects that the image carrier is brand new.

26. The process cartridge according to claim 14, wherein the image carrier is a photosensitive drum.

* * * * *